US011063386B2

(12) United States Patent
Itou et al.

(10) Patent No.: US 11,063,386 B2
(45) Date of Patent: Jul. 13, 2021

(54) CONNECTOR WITH CONTACT REMOVABLY ATTACHED TO AN INSULATOR

(71) Applicant: Japan Aviation Electronics Industry, Limited, Tokyo (JP)

(72) Inventors: Yasukazu Itou, Tokyo (JP); Katsuhiko Nakazawa, Tokyo (JP)

(73) Assignee: Japan Aviation Electronics Industry, Limited, Tokyo (JP)

( * ) Notice: Subject to any disclaimer, the term of this patent is extended or adjusted under 35 U.S.C. 154(b) by 0 days.

(21) Appl. No.: 16/623,548

(22) PCT Filed: May 21, 2018

(86) PCT No.: PCT/JP2018/019534
§ 371 (c)(1),
(2) Date: Dec. 17, 2019

(87) PCT Pub. No.: WO2019/012809
PCT Pub. Date: Jan. 17, 2019

(65) Prior Publication Data

US 2020/0144758 A1 May 7, 2020

(30) Foreign Application Priority Data

Jul. 14, 2017 (JP) ..... JP2017-137900

(51) Int. Cl.
*H01R 13/508* (2006.01)
*H01R 13/422* (2006.01)
*H01R 13/639* (2006.01)

(52) U.S. Cl.
CPC ..... *H01R 13/508* (2013.01); *H01R 13/422* (2013.01); *H01R 13/639* (2013.01)

(58) Field of Classification Search
CPC ... H01R 13/508; H01R 13/422; H01R 13/639
See application file for complete search history.

(56) References Cited

U.S. PATENT DOCUMENTS 5,059,142 A 10/1991 Ohta et al.
5,240,424 A * 8/1993 Honma ..... H01R 13/639 439/95

(Continued)

FOREIGN PATENT DOCUMENTS

CN 1612415 A 5/2005
CN 102437457 A 5/2012

(Continued)

OTHER PUBLICATIONS

International Search Report in PCT/JP2018/019534, dated Jul. 31, 2018.

(Continued)

*Primary Examiner* — Abdullah A Riyami
*Assistant Examiner* — Nader J Alhawamdeh
(74) *Attorney, Agent, or Firm* — Collard & Roe, P.C.

(57) ABSTRACT

A connector is provided with terminals, stoppers, and a socket insulator. The stoppers are attached to the respective terminals and are housed together with the terminals in the housing parts of the socket insulator. The stoppers are provided with parts to be locked, and lock spring parts that support the parts to be locked. Locking parts and operation parts are formed on the socket insulator. When the stoppers are housed in the housing parts, the locking parts are located rearward of the parts to be locked, and the locking parts restrict rearward movement of the stoppers. The operation parts can be operated in a prescribed direction that intersects the longitudinal direction. When operated, the operation parts cause the parts to be locked to move in the prescribed direction, and the restriction applied by the locking parts to the parts to be locked in released.

8 Claims, 21 Drawing Sheets

(56) References Cited

U.S. PATENT DOCUMENTS

| | | | | |
|---|---|---|---|---|
| 5,718,596 | A * | 2/1998 | Inaba | H01R 13/6271 439/352 |
| 6,149,472 | A * | 11/2000 | Endo | H01R 13/4226 439/745 |
| 7,011,553 | B2 | 3/2006 | Hayashi et al. | |
| 7,591,682 | B2 | 9/2009 | Umemura et al. | |
| 8,523,594 | B2 | 9/2013 | Takeda et al. | |
| 2014/0073163 | A1 | 3/2014 | Kojima et al. | |
| 2017/0194740 | A1* | 7/2017 | Nakazawa | H01R 13/44 |

FOREIGN PATENT DOCUMENTS

| | | | |
|---|---|---|---|
| CN | 204156216 | U | 2/2015 |
| DE | 35 26 664 | A1 | 2/1986 |
| EP | 2 712 033 | A1 | 3/2014 |
| GB | 2 308 928 | A | 7/1997 |
| GB | 2376356 | A | 11/2002 |
| JP | 2000-091014 | A | 3/2000 |
| JP | 2005-302398 | A | 10/2005 |
| JP | 2008-300079 | A | 12/2008 |
| JP | 2010-049866 | A | 3/2010 |
| JP | 2010-257863 | A | 11/2010 |
| JP | 3168192 | U | 6/2011 |
| JP | 2012-243546 | A | 12/2012 |

OTHER PUBLICATIONS

Extended European Search Report in EP 18832460.2, dated May 6, 2020.
Chinese Office Action in CN 201880044060.X, dated Aug. 4, 2020.

* cited by examiner

CONNECTOR WITH CONTACT REMOVABLY ATTACHED TO AN INSULATOR

CROSS REFERENCE TO RELATED APPLICATIONS

This application is the National Stage of PCT/JP2018/019534 filed on May 21, 2018, which claims priority under 35 U.S.C. § 119 of Japanese Application No. 2017-137900 filed on Jul. 14, 2017, the disclosure of which is incorporated by reference. The international application under PCT article 21(2) was not published in English.

TECHNICAL FIELD

This invention relates to a connector and, in particular, to a connector which is provided with a contact attached to an insulator so as to be removable.

BACKGROUND ART

There exists a connector, in which a contact is attached to an insulator, formed so that the contact is removable from the insulator for change or replacement of the contact. Such a connector is disclosed in Patent Document 1, for example.

Referring to FIG. 33, a connector 90 of Patent Document 1 is provided with a plurality of contacts 92 to be attached to cables 98, respectively, and an insulator 94 to be attached to the contacts 92. Moreover, referring to FIG. 34, the insulator 94 has a housing 940, a plurality of lock rings 944, a retaining block 948 and a latch releasing member 950. The housing 940 is formed with a plurality of cavities 942 which accommodate the contacts 92 (see FIG. 33), respectively.

As shown in FIG. 35, the lock rings 944 are arranged in the cavities 942, respectively. The retaining block 948 is fixed to a rear part of the housing 940, and thereby the lock rings 944 are fixed in the cavities 942 of the housing 940. The latch releasing member 950 is attached to the housing 940 via the retaining block 948. The latch releasing member 950 is relatively movable with respect to the retaining block 948 or the housing 940 in a front-rear direction.

As shown in FIG. 35, in a state that the contacts 92 are attached to the insulator 94, lance pieces 946 of the lock rings 944 are positioned rearward of latching protrusions 920 of the contacts 92 in the front-rear direction. With this structure, rearward movements of the contacts 92 relative to the insulator 94 are regulated. In this state, upon forward movement of the latch releasing member 950 relative to the housing 940, the latch releasing member 950 presses and spreads the lance pieces 946 as understood from FIG. 35. Thus, regulation of the contacts 92 by lance pieces 946 is released. As a result, the contacts 92 can be pulled out rearward of the insulator 94. In this manner, in the connector 90 of Patent Document 1, the contacts 92 can be detached from the insulator 94.

Here, Patent Document 1 does not disclose a structure of a mating connector. However, according to conjecture based on a shape of the connector 90, there is a relatively large gap between tip parts of mating contacts and a mating insulator holding the mating contacts. This means that the mating connector is not provided with an electric shock prevention structure which prevents a finger of a human from coming into contact with the mating contacts. In other words, the connector of Patent Document 1 does not consider a connection to the mating connector providing the electric shock prevention structure nor an electric shock prevention structure for itself at all.

PRIOR ART DOCUMENTS

Patent Document

Patent Document 1: JP2010-49866A

SUMMARY OF INVENTION

Technical Problem

In the connector 90 of Patent Document 1, in order to detach the contacts 92 from the insulator 94, the latch releasing member 950 must be moved in an opposite direction (forward) opposite to a direction (rearward) for detaching the contacts 92. Accordingly, the connector 90 of Patent Document 1 has a problem that detaching operation of the contacts 92 is difficult. This problem is especially remarkable in a state that the insulator 94 is attached to a panel of a device.

It is therefore an object of the present invention is to provide a connector in which contacts (terminals) attached to an insulator can be more easily detached from the insulator.

Solution to Problem

An aspect of the invention provides a connector attachable to a cable wherein:

the connector comprises a plurality of terminals, a plurality of stoppers and a socket insulator;

each of the terminals has a cylindrical part and a cable attachment part;

the cable attachment part is a portion to be attached to the cable and positioned rearward of the cylindrical part in a front-rear direction;

the stoppers are attached to the terminals, respectively;

each of the stoppers is provided with a locked part and a lock spring part;

the locked part is supported by the lock spring part;

the lock spring part is resiliently deformable;

the socket insulator is formed with a plurality of housing parts, a plurality of locking parts and a plurality of operation parts;

the housing parts extend in the front-rear direction;

the stoppers are housed in the housing parts together with terminals, respectively;

each of the housing parts has a front end portion which opens and is positioned forward of the cylindrical part in the front-rear direction;

the locking parts are positioned rearward of the locked parts and regulate rearward movements of the stoppers, respectively, in a state that the stoppers are housed in the housing parts;

the operation parts are operable in a predetermined direction intersecting the front-rear direction; and when operated, the operation parts move the locked parts along the predetermined direction to respectively release regulation of the locked parts caused by the operation parts.

Advantageous Effects of Invention

In the connector of the present invention, the operation part can be operated in the predetermined direction intersecting with the front-rear direction. With this structure, the terminals can be more easily detached from the socket insulator.

An appreciation of the objectives of the present invention and a more complete understanding of its structure may be had by studying the following description of the preferred embodiment and by referring to the accompanying drawings.

DESCRIPTION OF EMBODIMENTS

Figure 1:
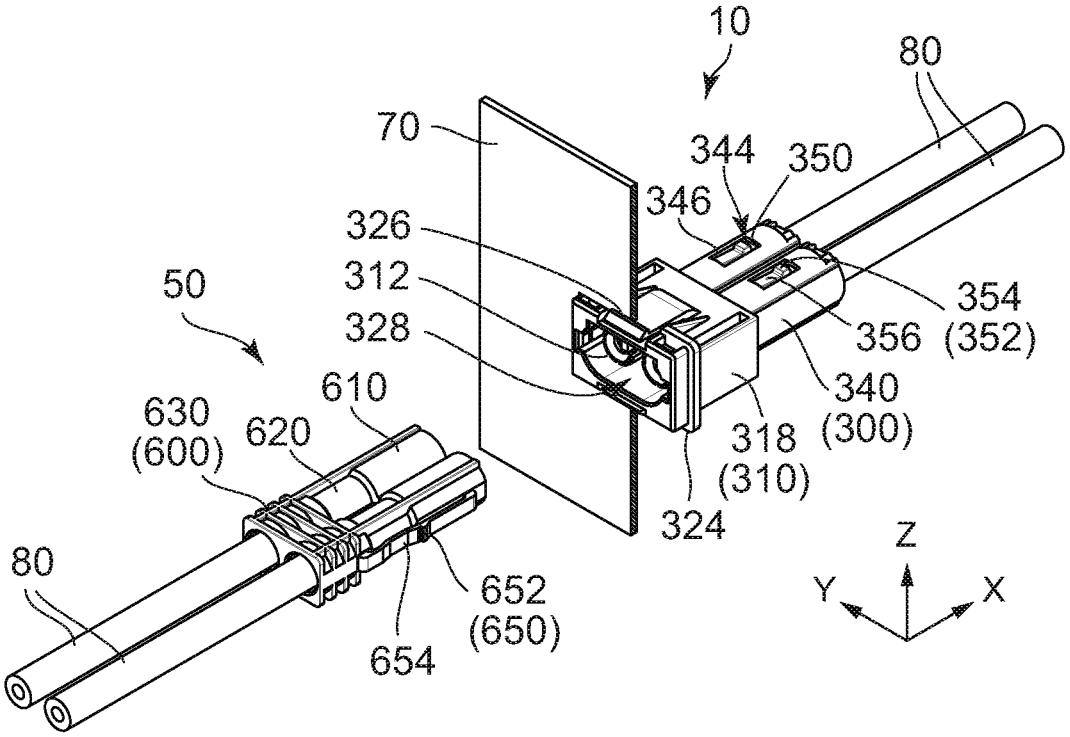
FIG. 1 is a perspective view showing a connector assembly according to an embodiment of the present invention together with a part of a panel. A connector is fixed to the panel. Each of the connector and a mating connector is connected to cables. The connector and the mating connector are not yet mated with each other.

While the invention is susceptible to various modifications and alternative forms, specific embodiments thereof are shown by way of example in the drawings and will herein be described in detail. It should be understood, however, that the drawings and detailed description thereto are not intended to limit the invention to the particular form disclosed, but on the contrary, the intention is to cover all modifications, equivalents and alternatives falling within the spirit and scope of the present invention as defined by the appended claims.

Figure 2:
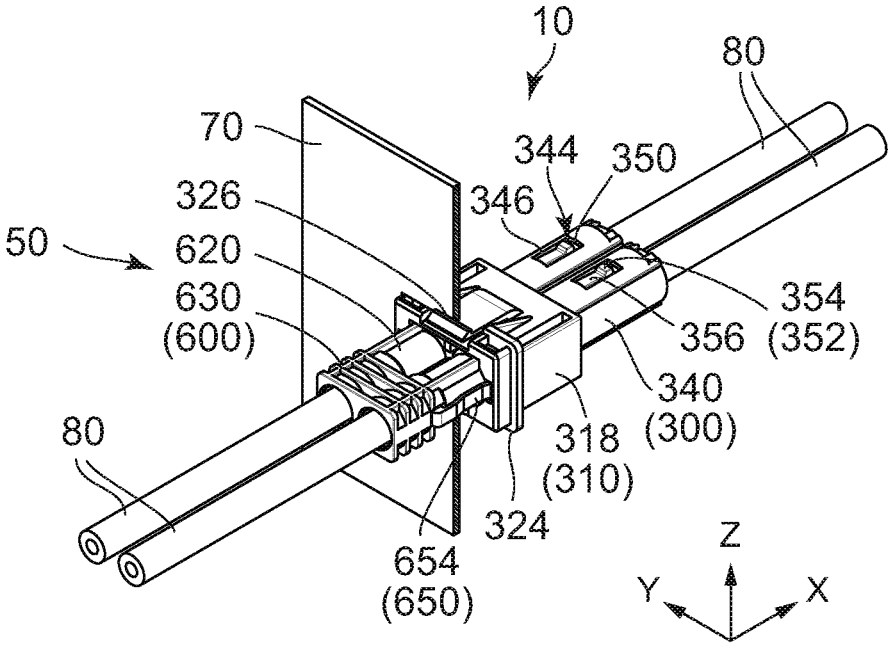
FIG. 2 is another perspective view showing the connector assembly of FIG. 1 together with the part of the panel. The connector and the mating connector are mated with each other.

Referring to FIGS. 1 and 2, each of a connector 10 and a mating connector 50 is attached to end parts of two cables 80. However, the present invention is not limited thereto. For example, each of the connector 10 and the mating connector 50 may be attached to an end part of a single multi-conductor cable.

As understood from FIGS. 1 and 2, the connector 10 and the mating connector 50 are mateable with and detachable from each other along a front-rear direction (a mating direction). The connector 10 and the mating connector 50 are mated with each other to form a connector assembly. In the present embodiment, the front-rear direction is an X-direction. A negative X-direction is directed forward while a positive X-direction is directed rearward.

Figure 3:
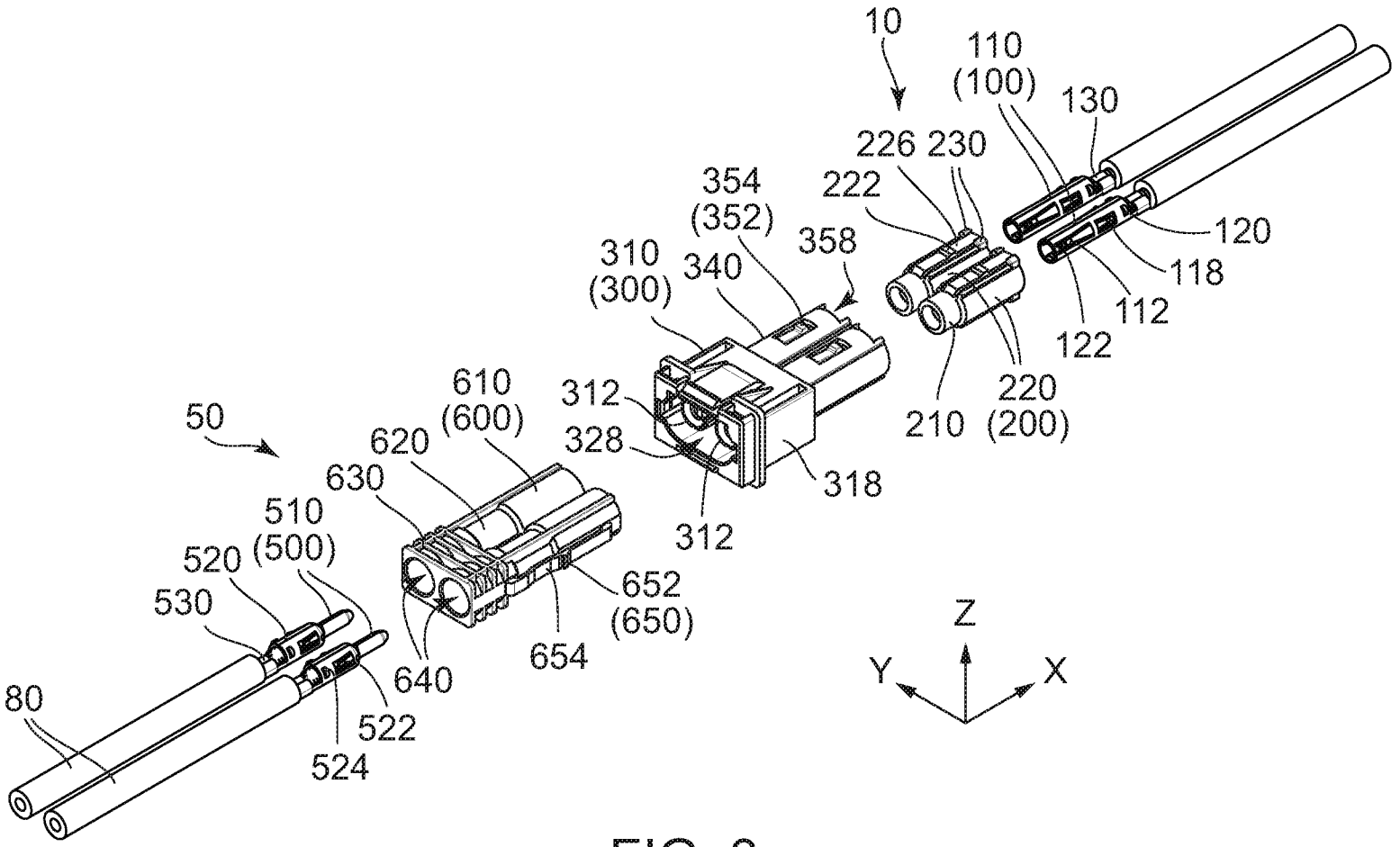
FIG. 3 is an exploded perspective view showing the connector assembly of FIG. 1.

Referring to FIG. 3, the connector 10 is provided with a plurality of socket contacts (terminals) 100, a plurality of stoppers 200 and a socket insulator 300. On the other hand, the mating connector 50 is provided with a plurality of pin contacts 500 and a pin insulator 600. In the present embodiment, each of the number of the socket contacts 100, the number of the stoppers 200 and the number of the pin contacts 500 is two. However, the present invention is not limited thereto. The connector 10 may be provided with three or more socket contacts 100. In that case, the connector 10 is provided with stoppers 200 equal to the socket contacts 100 in number. Moreover, the mating connector 50 is provided with pin contacts 500 equal to the socket contacts 100 in number.

Figure 4:
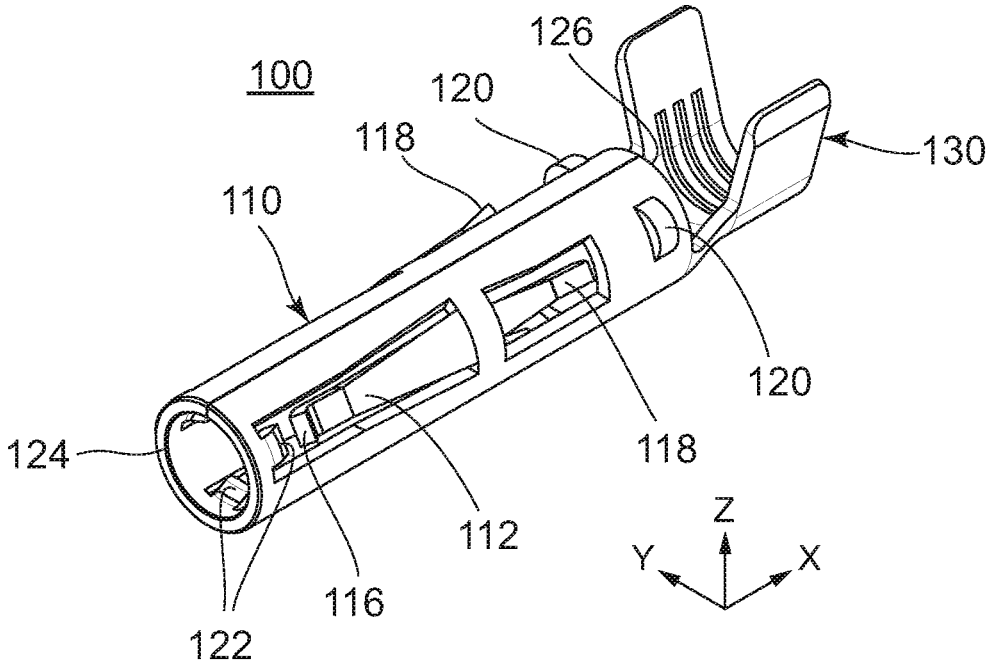
FIG. 4 is a perspective view showing a socket contact included in the connector used to form the connector assembly of FIG. 1.
Figure 5:
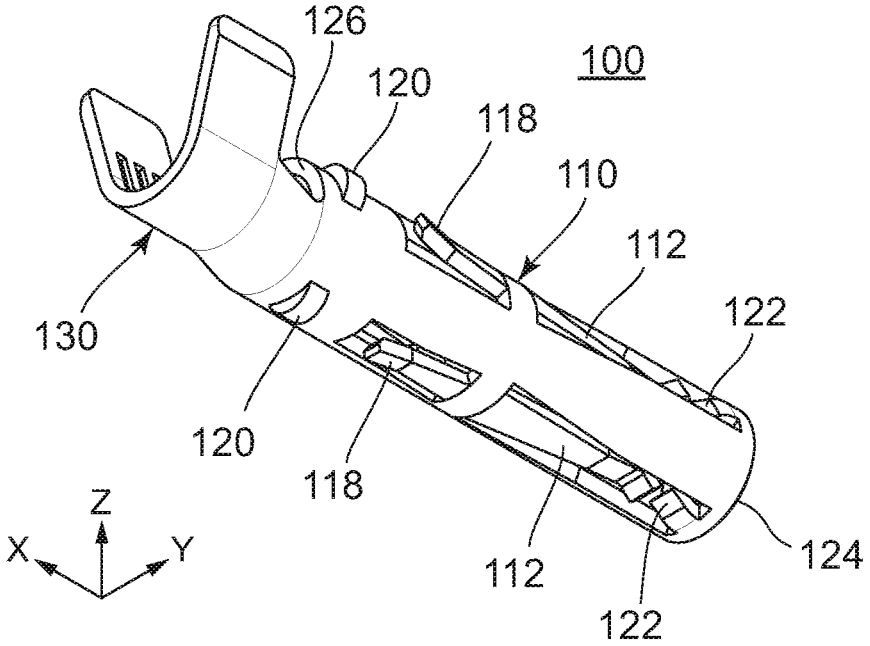
FIG. 5 is another perspective view showing the socket contact of FIG. 4.
Figure 6:
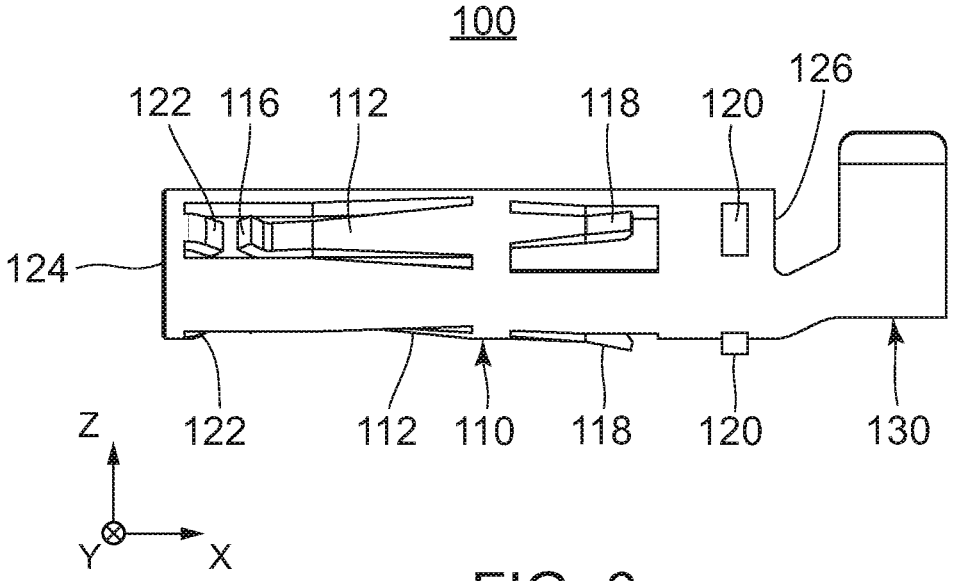
FIG. 6 is a side view showing the socket contact of FIG. 4.
Figure 7:
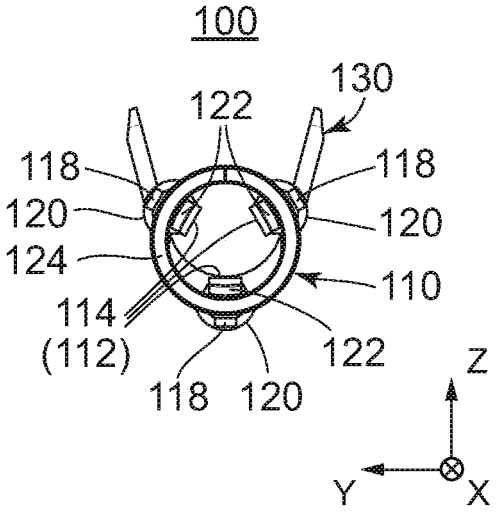
FIG. 7 is a front view showing the socket contact of FIG. 4.
Figure 25:
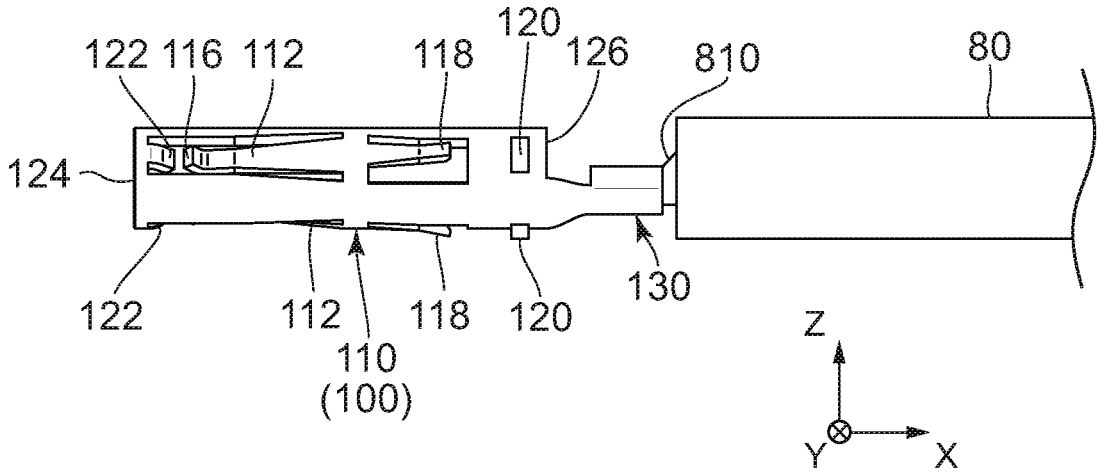
FIG. 25 is a side view showing a state that the socket contact of FIG. 6 is attached to the cable.
Figure 32:
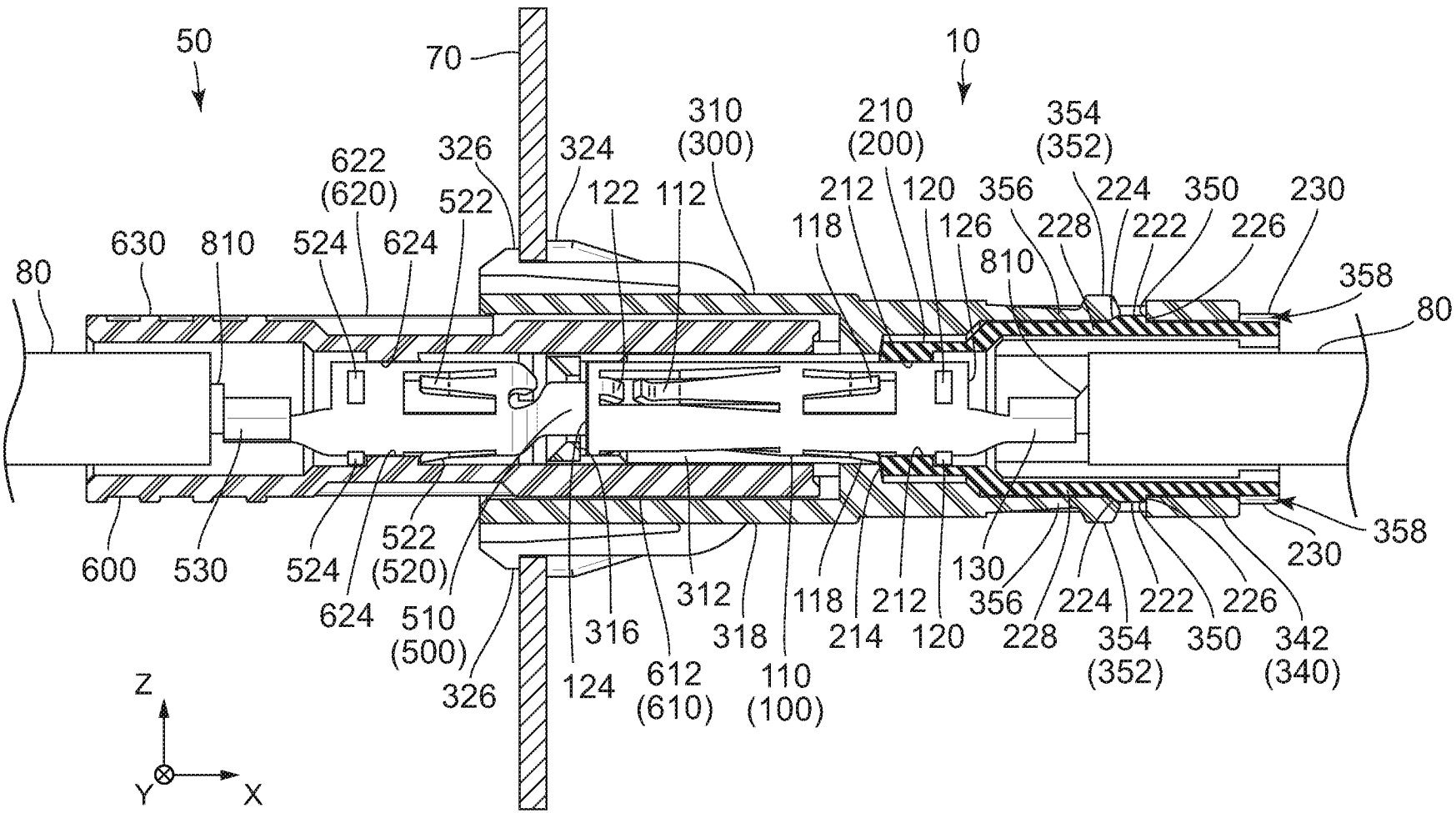
FIG. 32 is a vertical, partly sectional view showing the connector assembly of FIG. 29. It includes side views of the socket contact and the pin contact and vertical, sectional views of the socket insulator, the stopper, the pin insulator and the panel.
Figure 33:
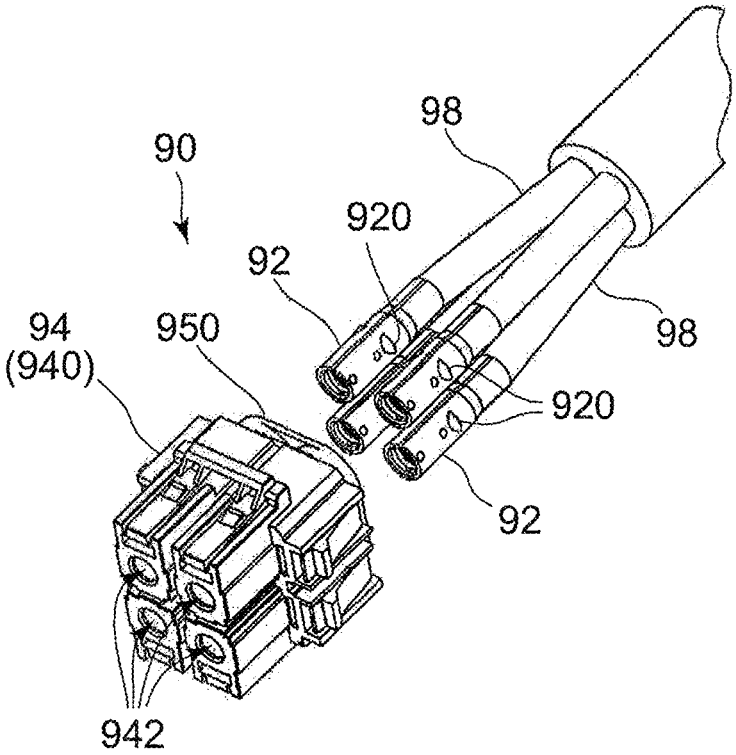
FIG. 33 PRIOR ART
FIG. 33 is an exploded, perspective view showing a connector of Patent Document 1.
Figure 34:
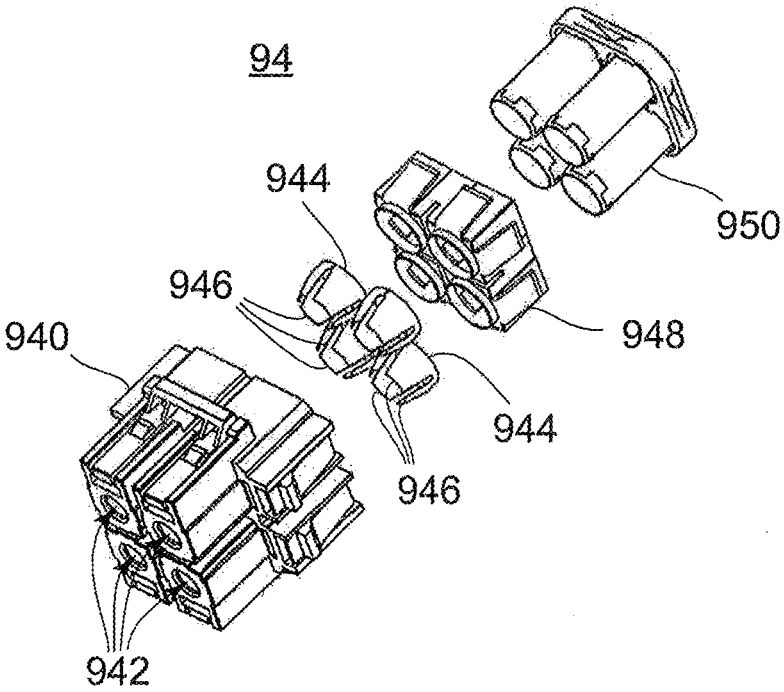
FIG. 34 PRIOR ART
FIG. 34 is an exploded, perspective view showing an insulator included in the connector of FIG. 33.
Figure 35:
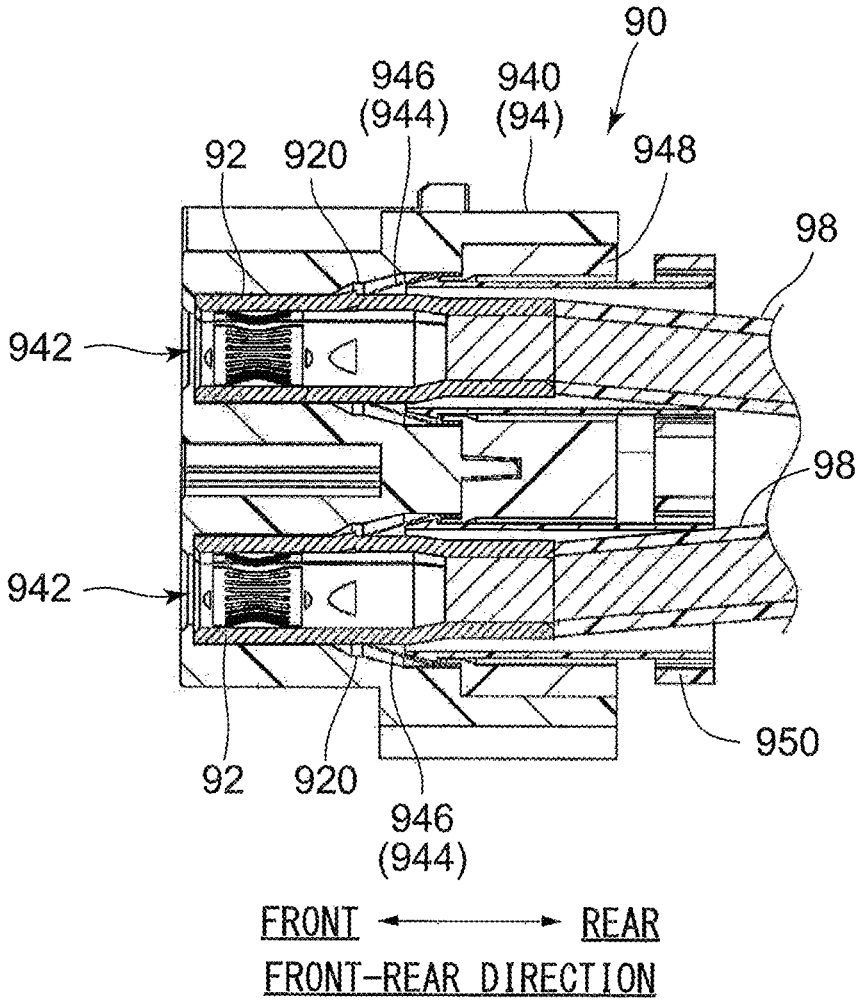
FIG. 35 PRIOR ART
FIG. 35 is a cross-sectional view showing the connector of FIG. 33.

Referring to FIGS. 4 to 6, the socket contact 100 has a cylindrical part 110 and a cable attachment part 130 contiguous to the cylindrical part 110. The cylindrical part 110 extends in the front-rear direction. The cylindrical part 110 defines radial directions perpendicular to the front-rear direction. The cylindrical part 110 is positioned forward of the cable attachment part 130 in the front-rear direction. In other words, the cable attachment part 130 is positioned rearward of the cylindrical part 110 in the front-rear direction. The cylindrical part 110 is a part for receiving a portion of the pin contact 500 (see FIG. 29 or FIG. 32) when the connector 10 and the mating connector 50 are mated with each other. The cable attachment part 130 is a part to be attached to the cable 80 (see FIG. 3). In detail, as shown in FIG. 25, the cable attachment part 130 is a part to be crimped to a core wire 810 of the cable 80. However, the cable attachment part 130 may be attached to the core wire 810 of the cable 80 by a method other than the crimping, for example, by soldering. The socket contact 100 is formed by punching out a metal sheet and bending it.

As shown in FIGS. 4 to 7, the cylindrical part 110 is provided with a plurality of contact-point-support parts 112, a plurality of latching springs 118, a plurality of latching protrusions 120 and a plurality of guide parts 122. The contact-point-support parts 112 are arranged at regular intervals in a circumferential direction of the cylindrical part 110. The same is true on the latching springs 118, the latching protrusions 120 and the guide parts 122. The guide parts 122, the contact-point-support parts 112, the latching springs 118 and the latching protrusions 120 are arranged in this order in the front-rear direction. In the present embodiment, each of the number of the contact-point-support parts 112, the number of the latching springs 118, the number of the latching protrusions 120 and the number of the guide parts 122 is three. However, the present invention is not limited thereto. But, at least one of the contact-point-support parts 112, at least one of the latching springs 118, at least one of the latching protrusions 120 and at least one of the guide parts 122 should be provided.

As shown in FIGS. 4 to 6, each of the contact-point-support parts 112 is formed like a cantilever. In detail, the contact-point-support part 112 extends diagonally forward from a middle part of the cylindrical part 110 in the front-rear direction and protrudes inward from the cylindrical part 110 in the radial direction of the cylindrical part 110. The contact-point-support part 112 supports a contact point 114 (see FIG. 7) and is resiliently deformable. In other words, the contact-point-support part 112 supports the contact point 114 so as to be movable at least in the radial direction of the cylindrical part 110. Additionally, in the present embodiment, the contact point 114 is formed as a part of the contact-point-support part 112.

As shown in FIGS. 4 to 6, each of the latching springs 118 is formed like a cantilever. In detail, the latching spring 118 extends diagonally rearward from the middle part of the cylindrical part 110 in the front-rear direction and protrudes outward from the cylindrical part 110 in the radial direction of the cylindrical part 110. The latching spring 118 is resiliently deformable. A length of the latching spring 118 in the front-rear direction is shorter than a length of the contact-point-support part 112 in the front-rear direction.

As shown in FIGS. 4 to 6, each of the latching protrusions 120 is positioned rearward of and apart from the latching spring 118 in the front-rear direction. In other words, the latching protrusion 120 is positioned near a rear end 126 of the cylindrical part 110. The cable attachment part 130 contiguous to the rear end 126 of the cylindrical part 110 is positioned rearward of the latching protrusion 120 in the front-rear direction. The latching protrusion 120 has an arch shape on a plane perpendicular to the front-rear direction and protrudes outward from the cylindrical part 110 in the radial direction of the cylindrical part 110.

As understood from FIGS. 4 to 6, each of the guide parts 122 extends diagonally rearward from a vicinity of a front end 124 of the cylindrical part 110 in the front-rear direction and protrudes inward from the cylindrical part 110 in the radial direction of the cylindrical part 110. As understood from FIG. 7, in the radial direction of the cylindrical part 110, a protrusion amount of the guide part 122 is less than a protrusion amount of the contact-point-support part 112. The guide part 122 guides the pin contact 500 (see FIGS. 28 and 29) and prevents the pin contact 500 from being brought into contact with a tip 116 (see FIGS. 4 and 6) of the contact-point-support part 112 when the socket contact 100 is inserted into the pin contact 500. With this structure, the contact-point-support part 112 is prevented from buckling.

Figure 8:
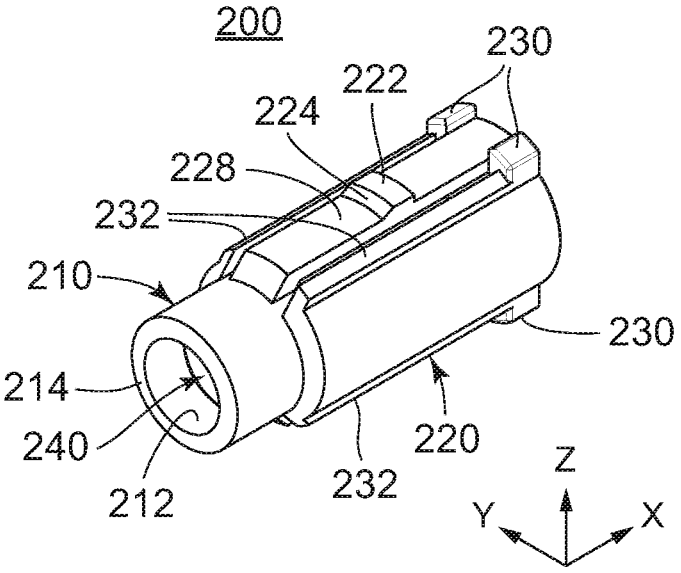
FIG. 8 is a perspective view showing a stopper included in the connector used to form the connector assembly of FIG. 1.
Figure 9:
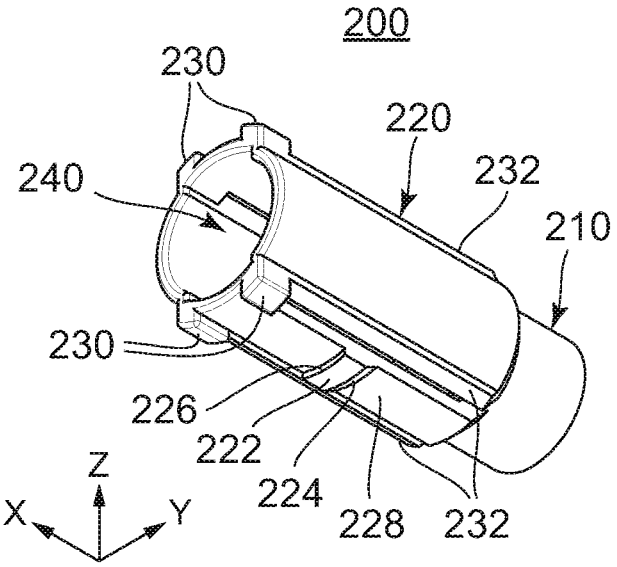
FIG. 9 is another perspective view showing the stopper of FIG. 8.
Figure 10:
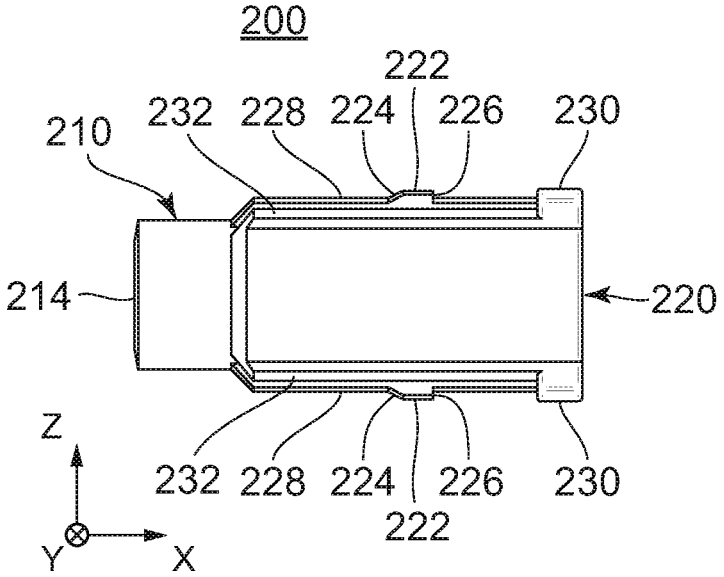
FIG. 10 is a side view showing the stopper of FIG. 8.
Figure 11:
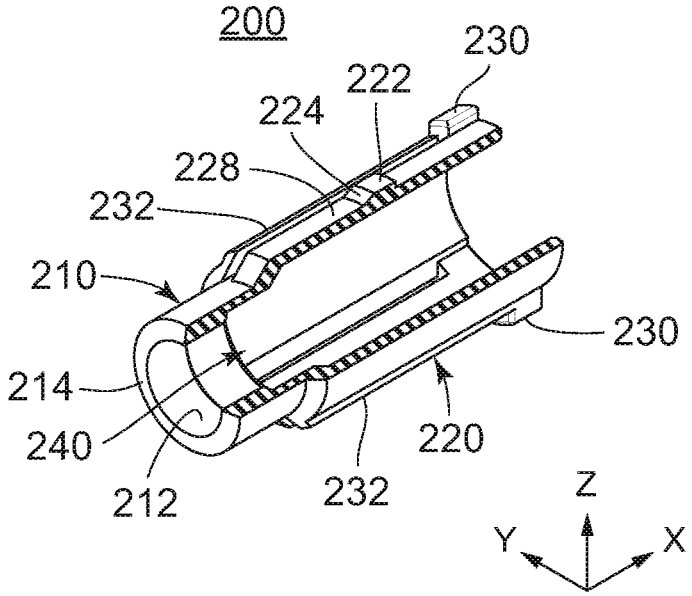
FIG. 11 is a perspective, sectional view showing the stopper of FIG. 8.

Referring to FIGS. 8 to 10, the stopper 200 is formed like a cylinder using insulating resin. In the present embodiment, the stopper 200 extends in the front-rear direction. The stopper 200 has a front part 210 with a cylindrical shape and a rear part 220 with an appropriately cylindrical shape. A size of the rear part 220 in the radial directions thereof is larger than a size of the front part 210 in the radial directions thereof. Referring to FIG. 11, the stopper 200 is provided with a receiving part 240 continuously piercing the front part 210 and the rear part 220. The receiving part 240 receives the socket contact 100 (see FIG. 26) in part, thereby the stopper 200 is attached to the socket contact 100.

As shown in FIGS. 8 to 11, the rear part 220 of the stopper 200 is provided with at least one locked part 222 and at least one lock spring part 228. In the present embodiment, each of the number of the locked parts 222 and the number of the lock spring parts 228 is two. The lock spring part 228 is a double-supported spring extending in the front-rear direction. Since the lock spring part 228 is the double-supported spring, it can be prevented that, like a case where a cantilever is used, its tip is caught on something and turned up so that it is deformed or broken. The locked part 222 is positioned at a middle part of the lock spring part 228 in the front-rear direction. As shown in FIG. 10 particularly, in the present embodiment, the locked part 222 protrudes outward from the lock spring part 228 in an up-down direction. The lock spring part 228 is resiliently deformable and supports the locked part 222 so as to be movable at least in the up-down direction. In the present embodiment, the up-down direction is a Z-direction. A positive Z-direction is directed upward while a negative Z-direction directed downward.

As shown in FIGS. 8 to 11, in a circumferential direction of the rear part 220 of the stopper 200, on both sides of each of the lock spring parts 228, side part protrusions 232 are provided. In other words, the lock spring part 228 is positioned between the side part protrusions 232 of the pair in the circumferential direction of the rear part 220. The side part protrusions 232 protrude outside of the rear part 220 in the radial directions and extend in the front-rear direction. In the circumferential direction of the rear part 220, a predetermined interval is provided between the lock spring part 228 and each of the side part protrusions 232. The side part protrusions 232 protect the lock spring part 228 without disturbing normal operation of the lock spring part 228. In detail, the side part protrusions 232 receive accidental external forces, together with the locked part 222 and the lock spring part 228 or in substitute of these, to prevent the lock spring part 228 from excessively deforming.

As shown in FIGS. 8 to 11, a rear end part of the rear part 220 of the stopper 200 is formed with two pairs of rotation preventing protrusions 230. The rotation preventing protrusions 230 are coupled to the side part protrusions 232, respectively. The rotation preventing protrusions 230 protrude from the rear part 220 of the stopper 200 in the up-down direction. In detail, in the up-down direction, the rotation preventing protrusions 230 protrude outward of the side part protrusions 232. In the circumferential direction of the rear part 220, an end of the lock spring part 228 is positioned between the rotation preventing protrusions 230 of any one of the pairs. However, the present invention is not limited thereto. But, at least one of the rotation preventing protrusion 230 should be provided. Moreover, the rotation preventing protrusions 230 may be positioned apart from the lock spring parts 228 in the circumferential direction of the rear part 220.

As understood from FIG. 11, the front part 210 of the stopper 200 is formed with a latched part 212. In detail, the latched part 212 is a protruding part which is positioned in a front end 214 of the stopper 200 and formed all around along an inner circumference of the stopper 200. An internal diameter of the latched part 212 is slightly larger than an external diameter of the cylindrical part 110 of the socket contact 100 (see FIG. 30) except for the latching springs 118 and the latching protrusions 120. In other words, the internal diameter of the latched part 212 is set to allow the cylindrical part 110 of the socket contact 100 to pass therethrough and prevent the latching protrusions 120 from passing therethrough.

Referring to FIGS. 12 to 14 and 17, the socket insulator 300 has a front part 310 and a rear part 340 contiguous to the front part 310. The front part 310 has an approximately rectangular parallelepiped shape. The rear part 340 is positioned rearward of the front part 310 in the front-rear direction. The rear part 340 has a shape like two cylindrical parts 342 which extend in the front-rear direction and which are arranged in parallel with each other so as to be coupled with each other. The socket insulator 300 is formed in a single body using insulating resin.

Figure 12:
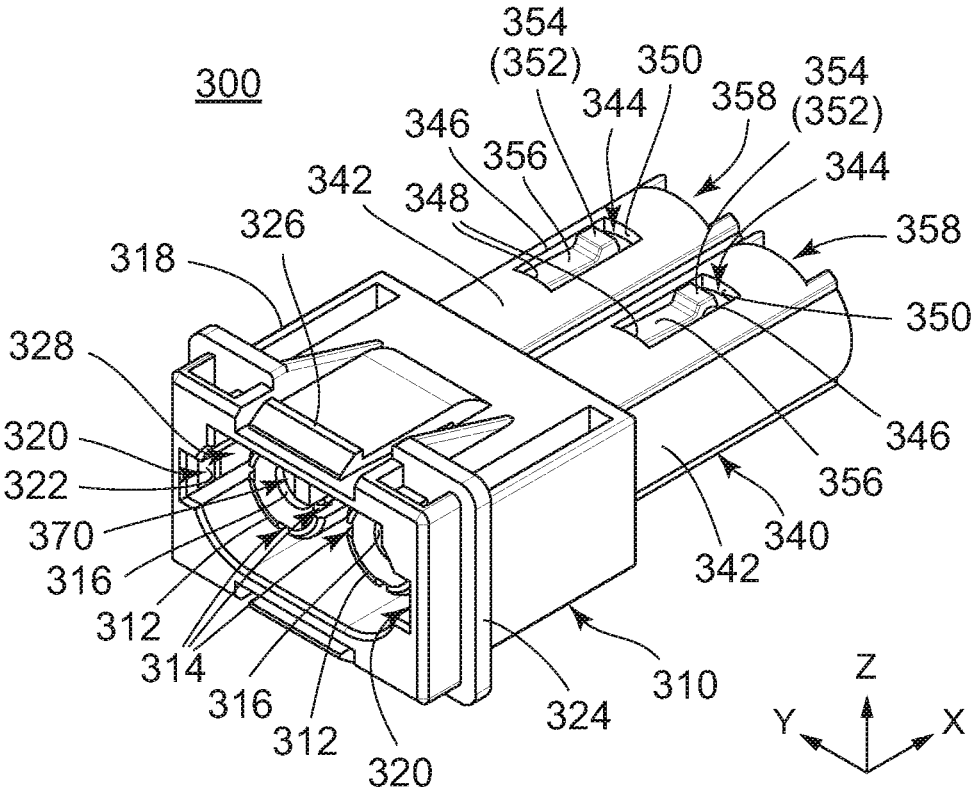
FIG. 12 is a perspective view showing a socket insulator included in the connector used to form the connector assembly of FIG. 1.
Figure 15:
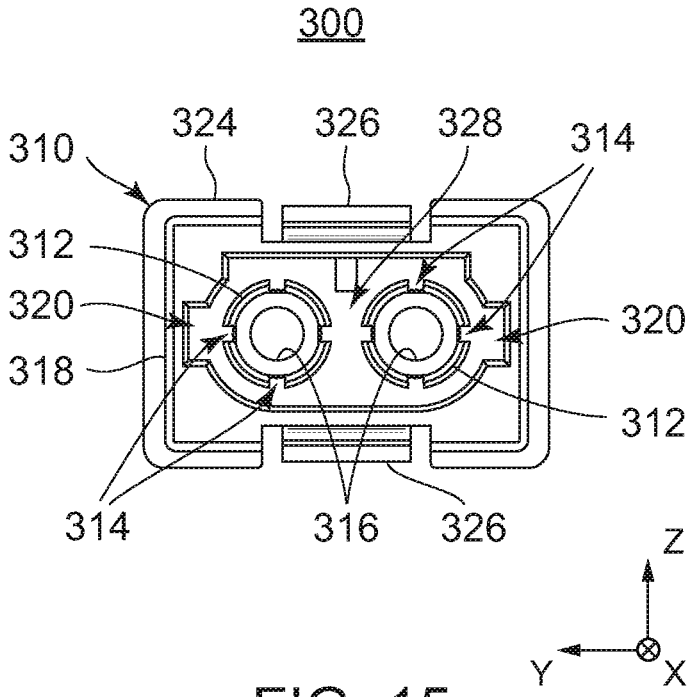
FIG. 15 is a front view showing the socket insulator of FIG. 12.
Figure 17:
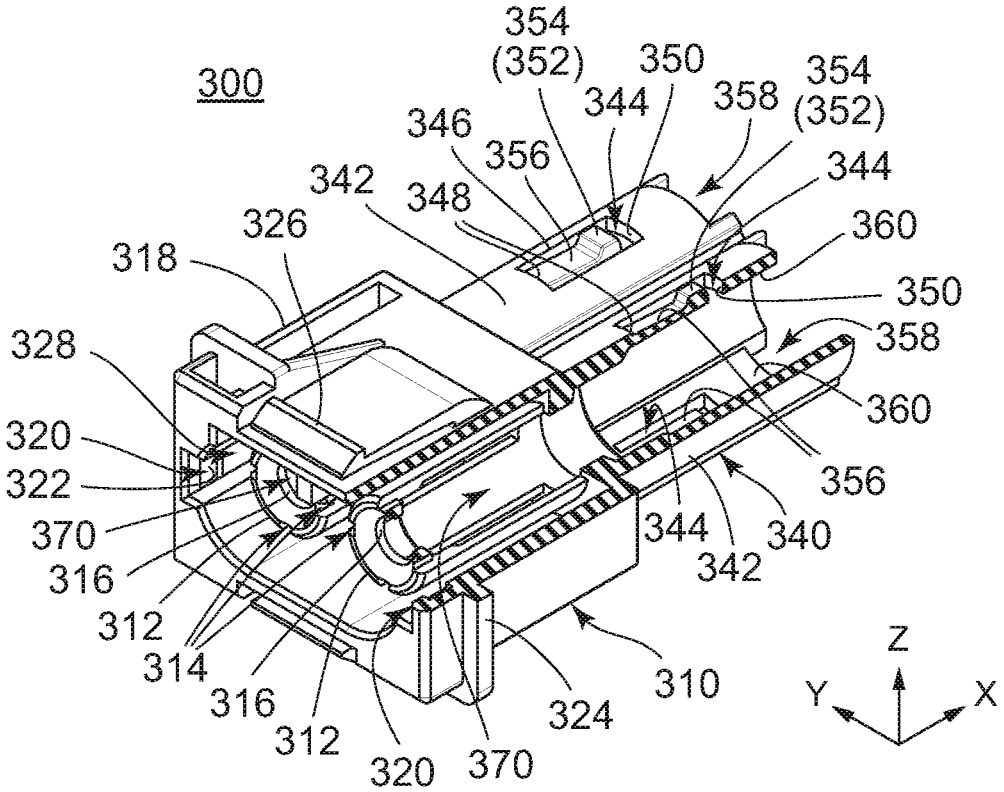
FIG. 17 is a perspective, sectional view showing the socket insulator of FIG. 12.
Figure 22:
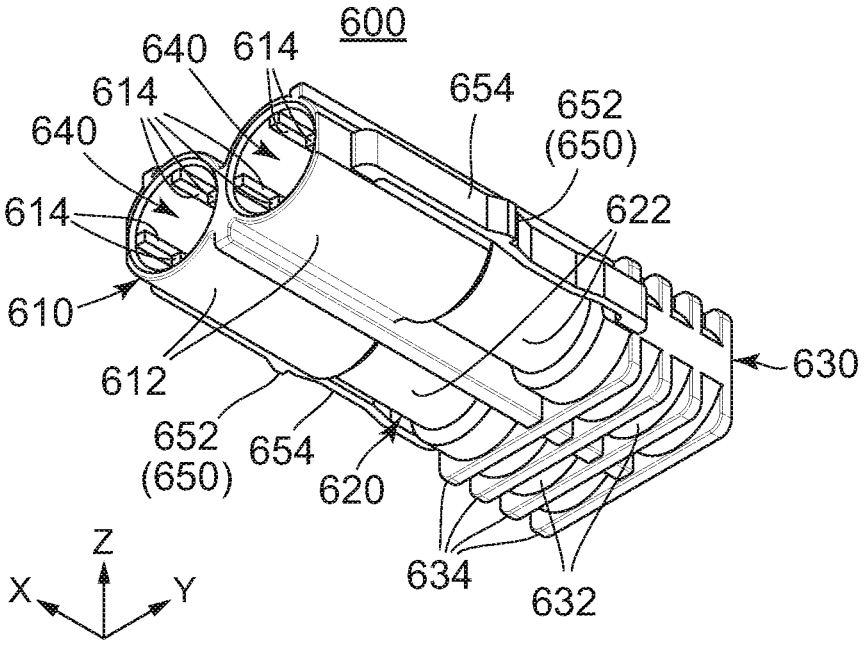
FIG. 22 is another perspective view showing the pin insulator of FIG. 21.
Figure 23:
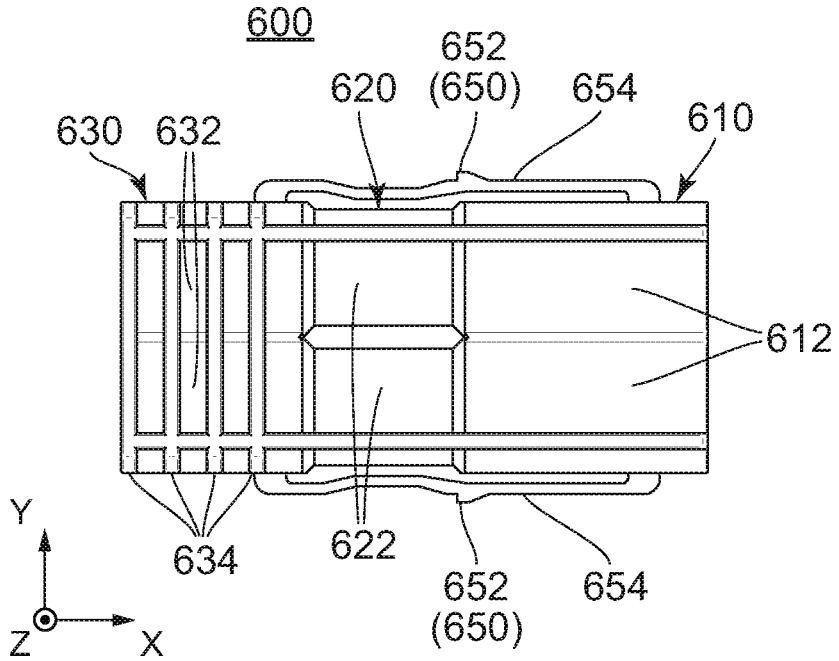
FIG. 23 is a top view showing the pin insulator of FIG. 21.

As understood from FIGS. 12, 15 and 17, the front part 310 of the socket insulator 300 has two inner cylindrical parts 312 and an outer cylindrical part 318. The outer cylindrical part 318 surrounds the inner cylindrical parts 312 in a plane perpendicular to the front-rear direction. Between the inner cylindrical parts 312 and the outer cylindrical part 318, an inserted part 328 is formed. The two inner cylindrical parts 312 are juxtaposed with each other at a predetermined interval in a lateral direction. In the present embodiment, the lateral direction is a Y-direction. In the present embodiment, each of the inner cylindrical parts 312 is formed with a plurality of slits 314 along the front-rear direction. The slits 314 correspond to internal protrusions 614 (see FIG. 22), which are mentioned later, of the pin insulator 600. In detail, the slits 314 receive the internal protrusions 614 at least in part when the connector 10 and the mating connector 50 are mated with each other. As understood from FIG. 17, the inner cylindrical parts 312 are coupled with the outer cylindrical part 318 at their rear end parts. As shown in FIGS. 12 and 17, sidewalls of the outer cylindrical part 318 are formed with guide grooves 320 and fitting lock parts 322.

As shown in FIG. 17, the inner cylindrical parts 312 communicate with cylindrical parts 342 of the rear part 340, respectively. In other words, the inner cylindrical parts 312 and the cylindrical parts 342 form socket accommodation parts (housing parts) 370 extending in the front-rear direction. That is, the socket insulator 300 is formed with a plurality of the socket accommodation parts 370 extending in the front-rear direction. Each of the socket accommodation parts 370 accommodates the stopper 200 (see FIG. 30) together with the socket contact 100 (see FIG. 30).

As shown in FIGS. 12, 15 and 17, a front-end part of each of the inner cylindrical parts 312 is formed with a contact stopper 316 to prevent the socket contact 100 (see FIG. 30) from moving forward. The contact stopper 316 is a protrusion protruding inward in radial directions of the inner cylindrical part 312. The contact stopper 316 is formed all around along an inner circumference of the inner cylindrical part 312. An internal diameter of the contact stopper 316, or an internal diameter of the front-end part of the inner cylindrical part 312, is smaller than the external diameter of the cylindrical part 110 of the socket contact 100. With this structure, the socket contact 100 accommodated in the socket accommodation part 370 is prevented from moving forward. In other words, the front-end part of the inner cylindrical part 312 is always positioned forward of the cylindrical part 110 of the socket contact 100 in the front-rear direction (see FIG. 30). Moreover, in the present embodiment, the front-end part of the inner cylindrical part 312 is formed to prevent a test finger prescribed in Electrical Appliances and Materials Safety Act from coming into contact with the socket contact 100. In other words, the connector 10 is provided with an electric shock prevention structure. The front-end parts of the inner cylindrical parts 312 open forward and allow the pin contacts 500 (see FIGS. 28 and 29) to be inserted into the socket contacts 100 (see FIGS. 28 and 29).

As shown in FIGS. 12 to 17, the outer cylindrical part 318 is provided with flange parts 324 and fixing hooks 326. The flange parts 324 and the fixing hooks 326 function as a fixed part to be fixed to a panel 70 (see FIG. 30) of a device (not shown). In other words, the outer cylindrical part 318 is provided with the fixed part to be fixed to the panel 70 of the device.

Figure 13:
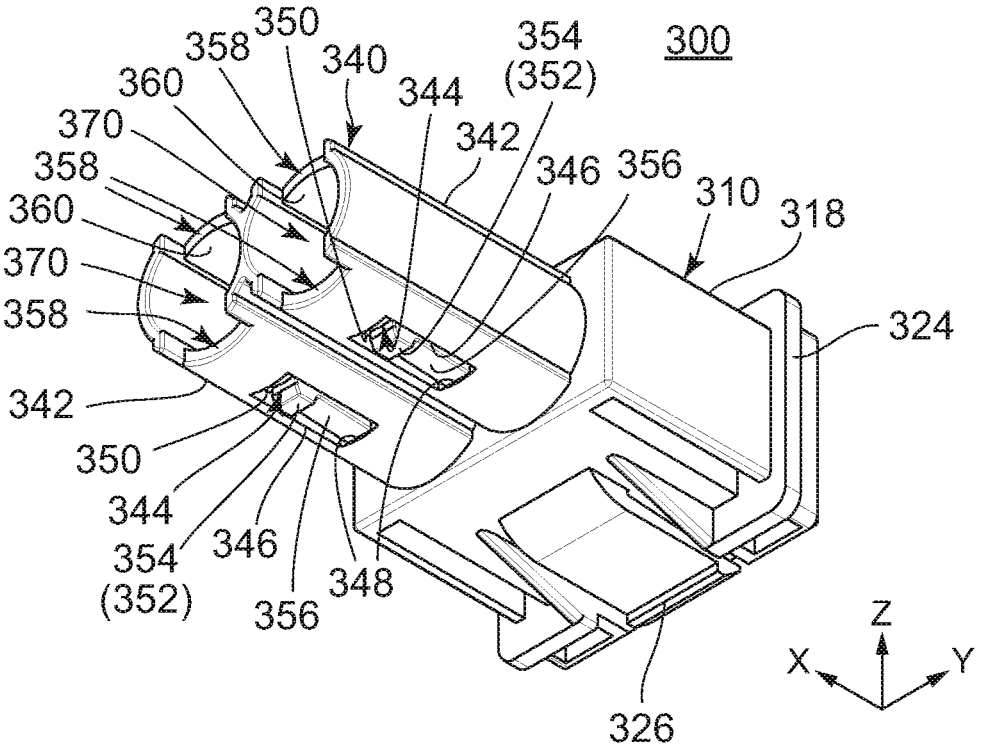
FIG. 13 is another perspective view showing the socket insulator of FIG. 12.

As shown in FIGS. 12, 13 and 17, the rear part 340 of the socket insulator 300 is formed with a plurality of apertures 344. In the present embodiment, the apertures 344 are formed in tops and bottoms of the cylindrical parts 342 one by one. Each of the apertures 344 has a rectangular shape when the socket insulator 300 is seen from above or beneath. In other words, the aperture 344 is defined by four edge parts. A front edge part 348, which is one of the four edge parts and positioned most forward among them in the front-rear direction, is provided with an operation part 352. The operation part 352 is surrounded by the four edge parts. In other words, the four edge parts form a surrounding part 346 which surrounds the operation part 352 in a plane perpendicular to the up-down direction. Moreover, a rear edge part 350, which is one of four edge parts and positioned most rearward among them in the front-rear direction, functions as a locking part as mentioned later. As just described, the socket insulator 300 is formed with a plurality of the operation parts 352, a plurality of the surrounding parts 346, which surround the operation parts 352, respectively, and a plurality of the locking parts 350.

Figure 14:
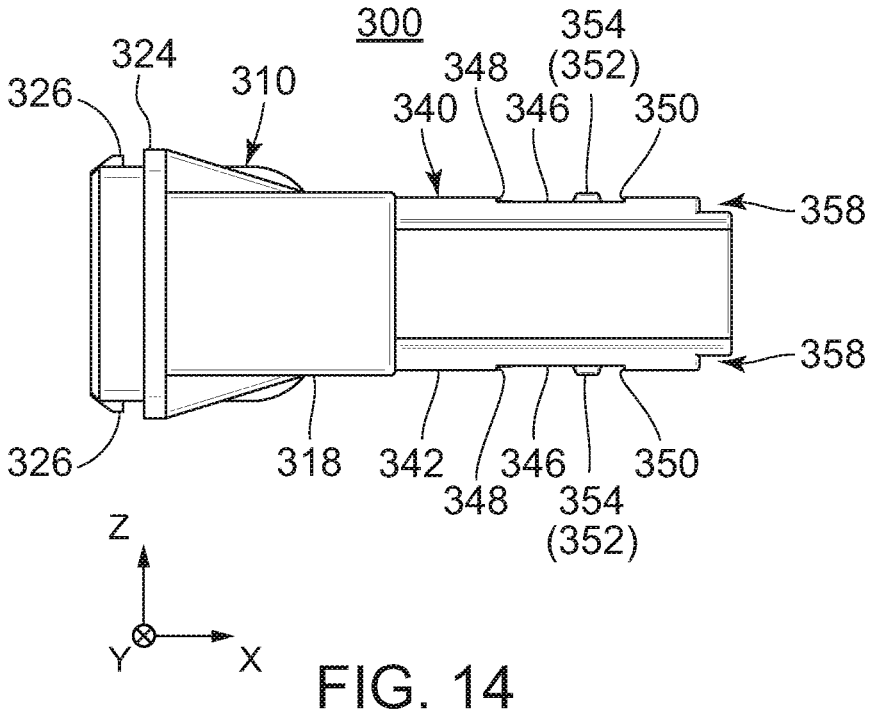
FIG. 14 is a side view showing the socket insulator of FIG. 12.

As understood from FIGS. 12, 13 and 17, each of the operation parts 352 has an operation protrusion 354 and an operation spring part 356. The operation spring part 356 is a cantilever spring extending rearward from the front edge part 348. The operation spring part 356 is resiliently deformable and supports the operation protrusion 354 so as to be movable in a predetermined direction intersecting with the front-rear direction. Accordingly, the operation part 352 is operable in the predetermined direction and movable in the predetermined direction by operation. In the present embodiment, the predetermined direction is a direction including an up-down direction component. As shown in FIG. 14, the operation protrusion 354 slightly protrudes outward from the surrounding part 346 in the predetermined direction or the up-down direction in a state where it is not operated. In other words, the operation protrusion 354 slightly protrudes outward in a radial direction of the cylindrical part 342. However, the operation protrusion 354 may not protrude from the surrounding part 346. Reduction of a protrusion amount of the operation protrusion 354 from the surrounding part 346 allows operation of the operation part 352 in the predetermined direction and prevents deformation or breakage, made by caught with something and turned up, of the operation part 352. Although the operation part 352 has the operation protrusion 354 and the operation spring part 356 in the present embodiment, it may be formed by nothing but the operation spring part 356.

Figure 16:
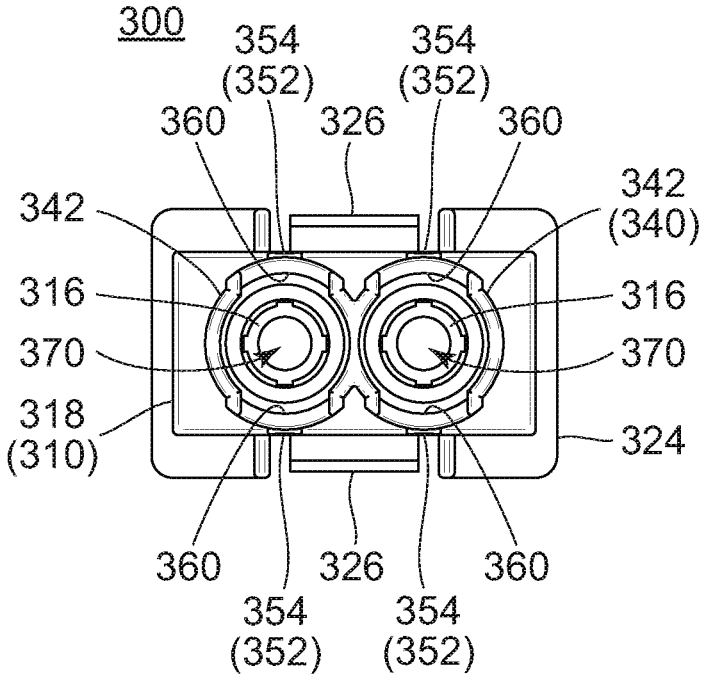
FIG. 16 is a rear view showing the socket insulator of FIG. 12.

As shown in FIGS. 13, 16 and 17, each of the cylindrical parts 342 of the rear part 340 of the socket insulator 300 is formed with a pair of shallow channel parts 360 in an inner wall thereof. The shallow channel parts 360 of the pair are positioned at upper and lower parts of the inner wall of the cylindrical part 342. The shallow channel parts 360 are recessed outward in the up-down direction and extend in the front-rear direction. In each of the shallow channel parts 360, the operation part 352 corresponding thereto is exposed in part. Each of the shallow channel parts 360 corresponds to one of the lock spring parts 228 of the stopper 200 (see FIG. 8) and to the side part protrusions 232 positioned at both sides of the lock spring part 228. Each of the shallow channel parts 360 has a volume for receiving the lock spring part 228 and the side part protrusions 232 positioned at both sides of the lock spring part 228 when the connector 10 and the mating connector 50 are mated with each other.

As shown in FIGS. 12 to 14 and 17, a rear end of the rear part 340 of the socket insulator 300 is formed with a plurality of recesses 358 which are recessed forward in the front-rear direction. The recesses 358 are positioned rearward of the shallow channel parts 360 in the front-rear direction. In the present embodiment, the recesses 358 are four in number. In detail, the recesses 358 are formed at upper and lower rear ends of the cylindrical parts 342, respectively. Each of the recesses 358 corresponds to each pair of the rotation preventing protrusions 230 (see FIG. 28 or 29).

As understood from FIGS. 3 and 25, attaching the socket contact 100 to the cable 80 is carried out by crimping the cable attachment part 130 to the core wire 810 of the cable 80. Accordingly, as understood from FIG. 26, when seen along the front-rear direction, a size of the cable attachment part 130 is smaller than a size of the cable 80. With this structure, the cable attachment part 130 can be received in the receiving part 240 of the stopper 200 together with the end part of the cable 80.

Figure 26:
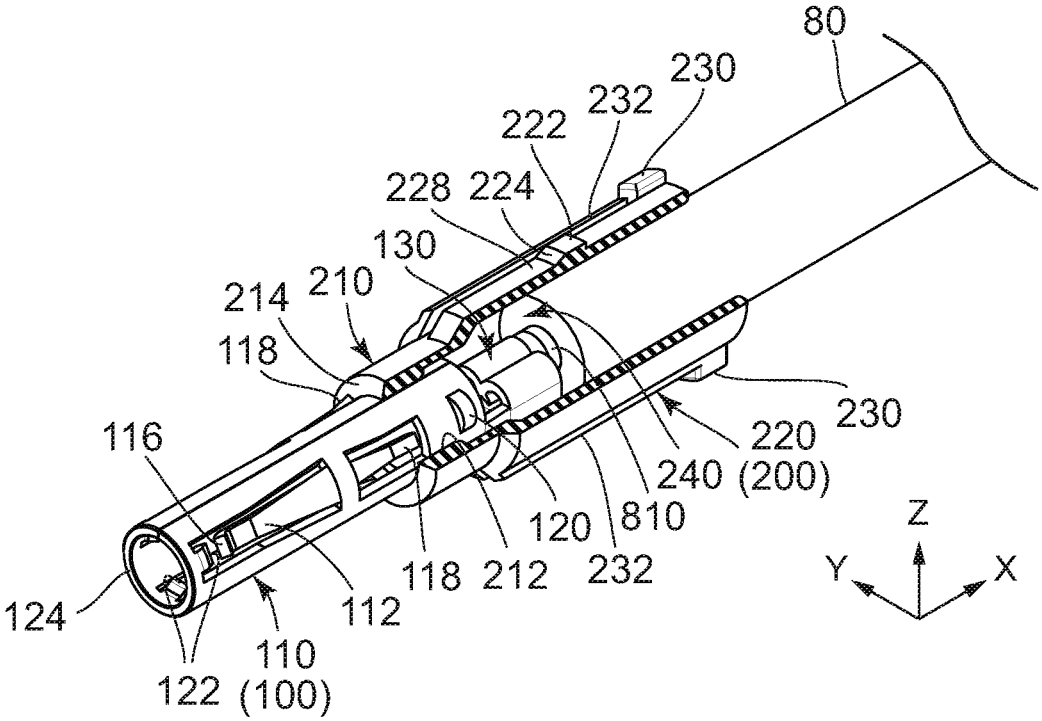
FIG. 26 is a partly sectional, perspective view showing a state that the stopper of FIG. 11 is attached to the socket contact of FIG. 25.

As understood from FIGS. 3 and 26, attaching the stopper 200 to the socket contact 100 is carried out by inserting the socket contact 100 into the stopper 200 from behind the stopper 200. As shown in FIG. 26, the front end 124 of the cylindrical part 110 of the socket contact 100 passes through the stopper 200 and is positioned forward of the front end 214 of the stopper 200 in the front-rear direction. As mentioned before, the latched part 212 of the stopper 200 is formed to prevent the latching springs 118 and the latching protrusions 120 of the socket contact 100 from passing therethrough. However, the latching springs 118 extend rearward in the front-rear direction and are resiliently deformable. Accordingly, the latching springs 118 are resiliently deformed upon coming into contact with the latched part 212 and can be moved forward beyond the latched part 212. The latching springs 118 return to their original state due to their reaction forces when they are moved forward of the latched part 212. Thus, the latching springs 118 are positioned forward of the stopper 200 in the front-rear direction. On the other hand, the latching protrusions 120 are brought into abutment with the latched part 212. The latching protrusions 120 cannot be resiliently deformed, and the socket contact 100 is regulated from being relatively moved forward with respect to the stopper 200. Thus, the stopper 200 is attached to the socket contact 100. In a state that the stopper 200 is attached to the socket contact 100, the latching springs 118 are brought into abutment with the latched part 212 when the socket contact 100 is moved rearward with respect to the stopper 200. As a result, rearward movement of the socket contact 100 relative to the stopper 200 is regulated. It should be noted that the stopper 200 can be detached from the socket contact 100 if the latching springs 118 are resiliently deformed inward in the radial directions of the cylindrical part 110 by the use of a jig (not shown).

As shown in FIG. 26, in the state that the stopper 200 is attached to the socket contact 100, the cable attachment part 130 of the socket contact 100 is positioned inside the receiving part 240 of the stopper 200 while the end part of the cable 80 is also positioned inside the receiving part 240 of the stopper 200. The latched part 212 of the stopper 200 is positioned between the latching springs 118 and the latching protrusions 120 in the front-rear direction, and movement of the socket contact 100 relative to the stopper 200 in the front-rear direction is regulated. On the other hand, the stopper 200 does not regulate rotation of the socket contact 100 around a rotation axis extending along the front-rear direction. Accordingly, the socket contact 100 can be freely rotated around the rotation axis extending along the front-rear direction if it is not connected to the cable 80. In other words, the socket contact 100 is held by the stopper 200 so as to be rotatable.

Figure 30:
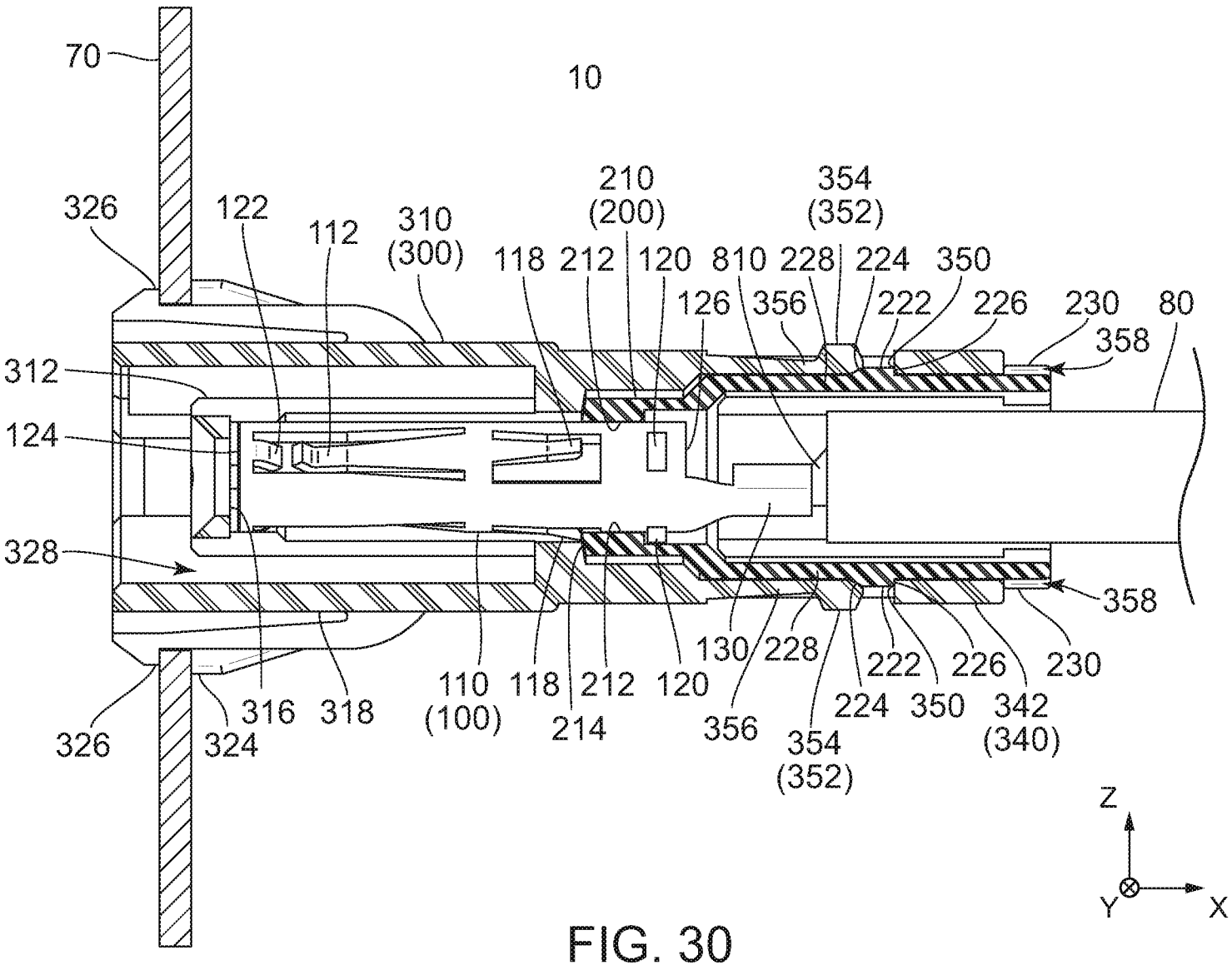
FIG. 30 is a vertical, partly sectional view showing the connector included in the connector assembly of FIG. 28 together with the panel. It includes a side view of the socket contact, a vertical, sectional view of the stopper and a vertical, sectional view of the socket insulator.

As understood from FIGS. 3 and 30, the stoppers 200 attached to the socket contacts 100 are inserted into the socket accommodation parts 370 (see FIG. 17) from behind the socket insulator 300. At this time, the rotation preventing protrusions 230 serve as an indicator indicating upper and lower sides of the stoppers 200. Moreover, as understood from FIGS. 8 and 13, the side part protrusions 232 of the stopper 200 and the shallow channel parts 360 of the socket insulator 300 work as a positioning mechanism to position the stopper 200 in its circumferential direction. That is, each of the shallow channel parts 360 regulates rotation of the stopper 200 around a rotation axis extending along the front-rear direction when it receives the lock spring part 228 and the side part protrusions 232 positioned at both sides of the lock spring part 228. The lock spring part 228 is positioned between the side part protrusions 232 and protected so as not to come into contact with the socket insulator 300 directly.

As understood from FIG. 30, the front end 124 of the cylindrical part 110 of the socket contact 100, which is accommodated in the socket accommodation part 370 (see FIG. 17) together with the stopper 200, is brought into abutment with the contact stopper 316 when it reaches a vicinity of a front end of the inner cylindrical part 312 of the socket insulator 300. This is because, as mentioned above, the internal diameter of the contact stopper 316 is smaller than the external diameter of the cylindrical part 110 of the socket contact 100. Thus, forward movements of the socket contacts 100 and the stoppers 200 relative to the socket insulator 300 are regulated.

As shown in FIG. 30, the stopper 200 is accommodated in the socket accommodation part 370 (see FIG. 17) in the rear part 340 of the socket insulator 300. Although the socket accommodation part 370 has a shape and a size which prevent the locked parts 222 from entering, the locked parts 222 can enter the inside of the socket accommodation part 370 due to resilient deformation of the lock spring parts 228. A front surface 224 of each of the locked parts 222 is inclined with respect to the front-rear direction to facilitate entering into the socket accommodation part 370. The locked part 222, which has entered in the inside of the socket accommodation part 370, enters into the aperture 344 (see FIG. 17) at least in part due to the reaction force of the lock spring part 228 when it is moved forward of the locking part 350 in the front-rear direction. As a result, the locked part 222 is positioned forward of the locking part 350 in the front-rear direction. In other words, the locking part 350 is positioned rearward of the locked part 222 in the front-rear direction. A rear surface 226 of the locked part 222 is perpendicular to the front-rear direction. Accordingly, rearward movement of the stopper 200 relative to the socket insulator 300 brings the locked part 222 into abutment with the locking part 350. In other words, the locking part 350 regulates rearward movement of the stopper 200 relative to the socket insulator 300. As a result, the stopper 200 is maintained in a state where the stopper 200 is accommodated in the socket accommodation part 370 of the socket insulator 300.

As understood from FIG. 30, in the state that the stopper 200 is accommodated in the socket accommodation part 370 (see FIG. 17), the operation protrusion 354 of the operation parts 352 is positioned near the locked part 222. In the present embodiment, the operation protrusion 354 is positioned diagonally forward of the locked part 222 and outward in a radial direction of the stopper 200. Although the operation part 352 is in contact with the front surface 224 of the locked part 222 in part in the present embodiment, the operation part 352 may not be in contact with the locked part 222. But, the operation part 352 should be positioned to allow resilient deformation of the lock spring part 228 by operation of the operation protrusion 354 in the predetermined direction.

As understood from FIG. 30, regulation of the locked part 222 by the locking part 350 is released when the operation protrusion 354 or the operation part 352 is operated so that the locked part 222 is moved inward of the locking part 350 in the radial direction of the stopper 200. When the stopper 200 is moved rearward relative to the socket contact 100 under the state that the regulation is released, the stopper 200 and the socket contact 100 can be drawn out from the socket accommodation part 370 (see FIG. 17). As just described, in the present embodiment, the socket contact 100 as well as the stopper 200 can be detached from the socket insulator 300 without using a jig, but with a simple structure in which the stopper 200 is added to a combination of the socket contact 100 and the socket insulator 300. In addition, an operating direction of the operation part 352 is the predetermined direction intersecting with the front-rear direction in the present embodiment. Therefore, operation of the operation part 352 and drawing the socket contact 100 can be carried out as a successive operation. Accordingly, even under circumstances where the socket insulator 300 is fixed to the panel 70 of the device and the operation part 352 is positioned inside the device, the socket contact 100 can be easily detached from the socket insulator 300.

Figure 28:
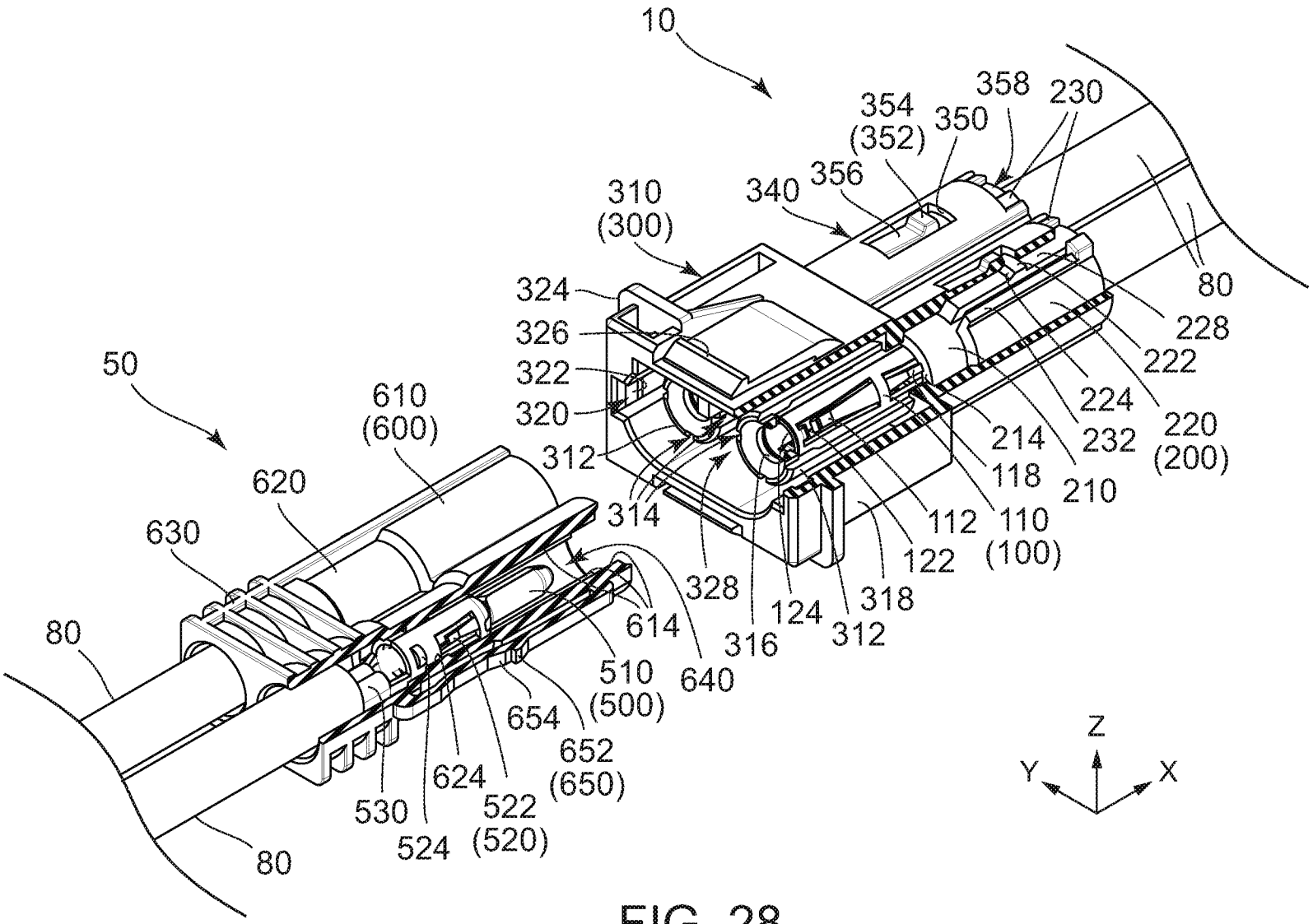
FIG. 28 is a partly sectional, perspective view showing the connector assembly of FIG. 1.
Figure 29:
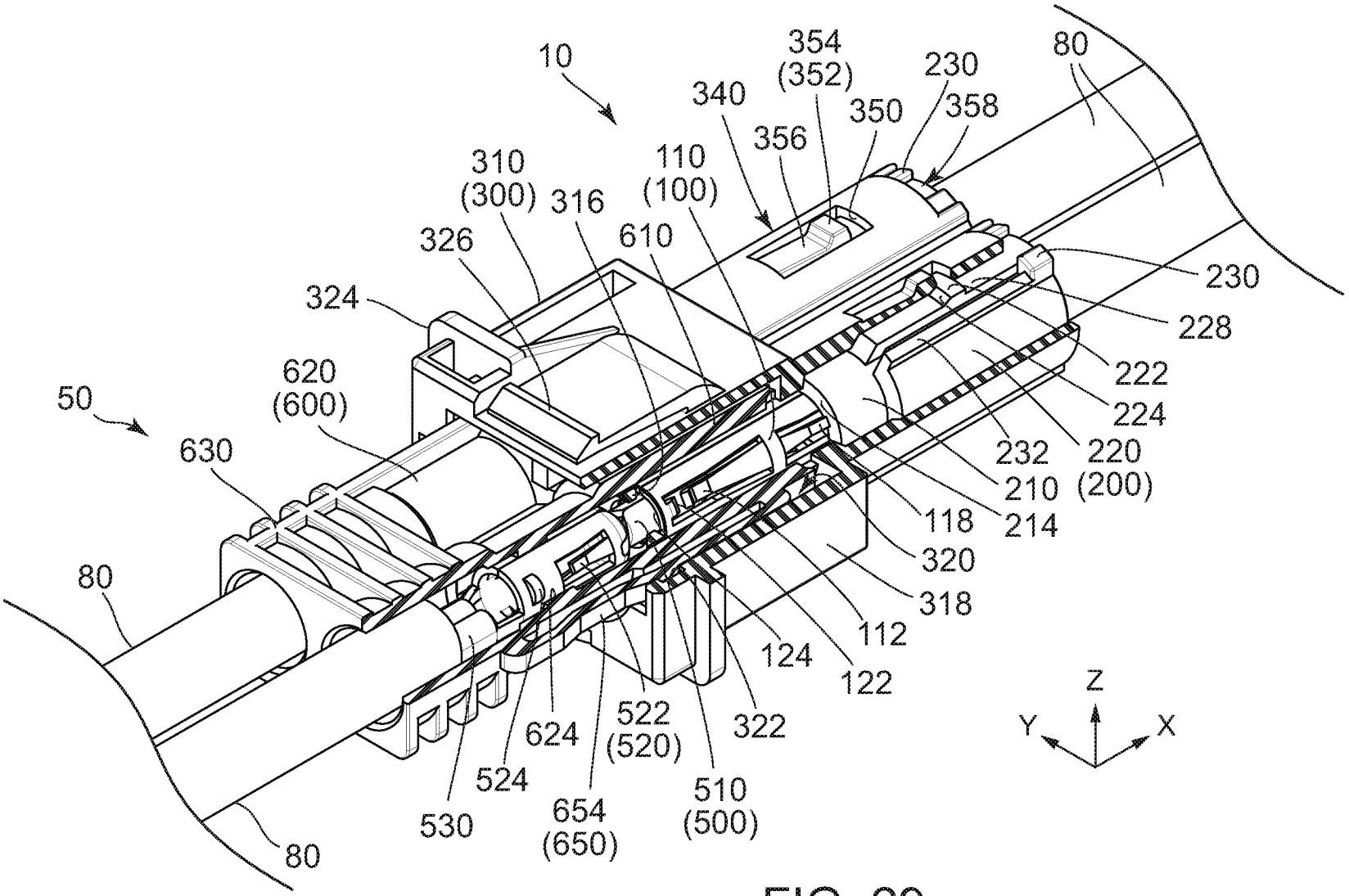
FIG. 29 is a partly sectional, perspective view showing the connector assembly of FIG. 2.

As shown in FIGS. 28 to 30, in the state that the stoppers 200 are held by the socket insulator 300, each of the recesses 358 receives the rotation preventing protrusions 230 of the pair. The rotation preventing protrusions 230 and the recess 358 function as a rotation regulation mechanism to regulate relative rotation of the stopper 200 with respect to the socket insulator 300. In detail, when the stopper 200 is tried to be rotated around the rotation axis extending along the front-rear direction, either one of the rotation preventing protrusions 230 is brought into abutment with an edge of the recesses 358 to regulate the relative rotation of the stopper 200 with respect to the socket insulator 300 in a circumferential direction of the cylindrical part 342. Thus, the stopper 200 is held by the socket insulator 300 so as not to be rotatable. On the other hand, the socket contact 100 is still relatively rotatable with respect to the stopper 200. In other words, the socket contact 100 is also relatively rotatable with respect to the socket insulator 300.

Figure 18:
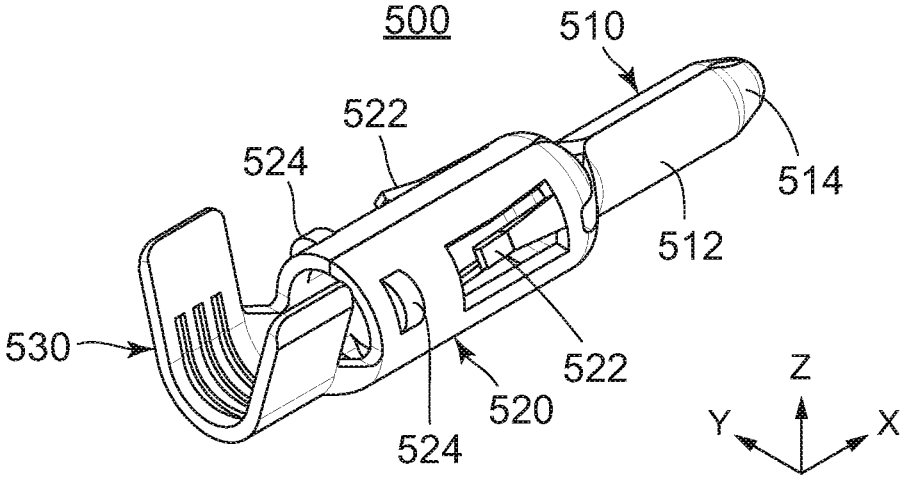
FIG. 18 is a perspective view showing a pin contact included in the mating connector used to form the connector assembly of FIG. 1.
Figure 19:
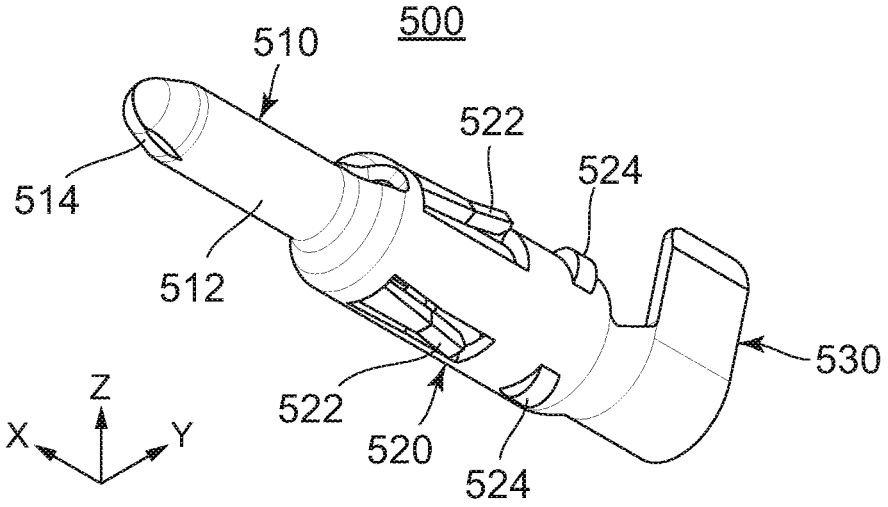
FIG. 19 is another perspective view showing the pin contact of FIG. 18.
Figure 20:
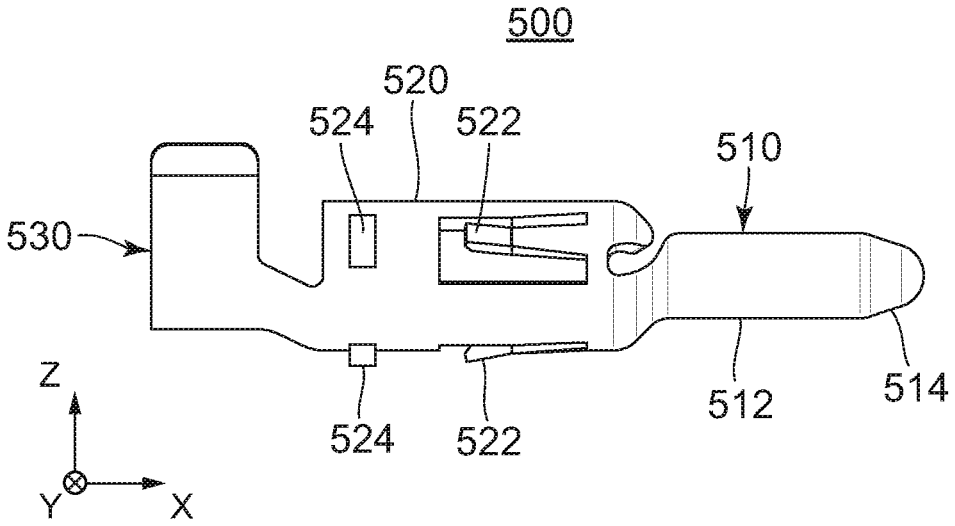
FIG. 20 is a side view showing the pin contact of FIG. 18.
Figure 21:
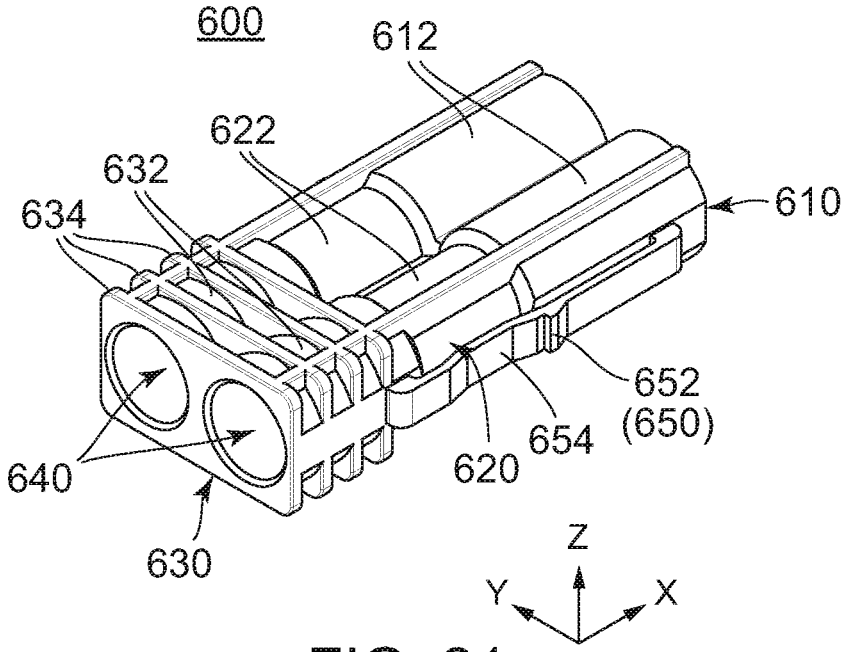
FIG. 21 is a perspective view showing a pin insulator included in the mating connector used to form the connector assembly of FIG. 1.
Figure 27:
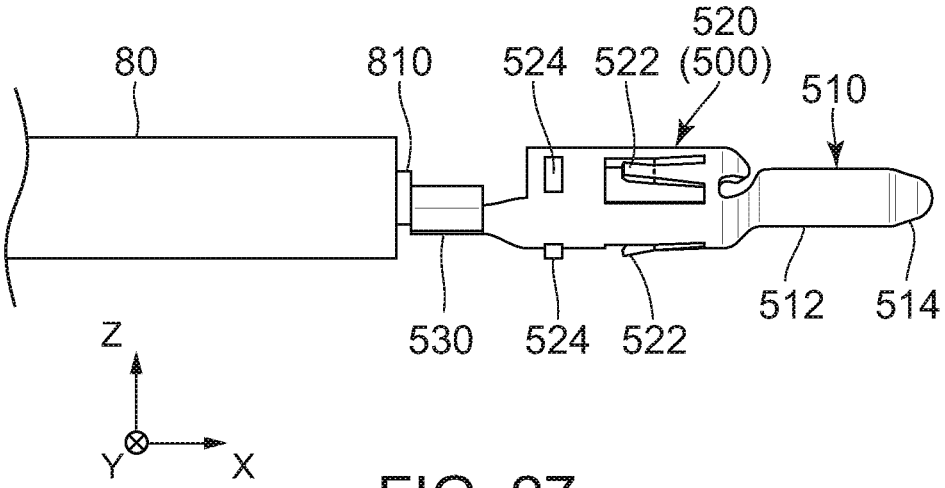
FIG. 27 is a side view showing a state that the pin contact of FIG. 20 is attached to the cable.

Referring to FIGS. 18 to 20, the pin contact 500 has a contact part 510, a held part 520 and a cable attachment part 530. The contact part 510 has a front part 512 with a cylindrical shape and a rear part 514 with a conical shape. The held part 520 is positioned forward of the contact part 510 in the front-rear direction. A shape of the held part 520 is an approximately cylindrical shape. An external diameter of the held part 520 is larger than an external diameter of the contact part 510. The held part 520 is formed with latched springs 522 and latched protrusions 524. Each of the latched springs 522 extends diagonally forward from a rear end part of the held part 520 in the front-rear direction and protrudes outward from the held part 520 in a radial direction of the held part 520. The latched protrusions 524 are positioned forward of the latched springs 522 in the front-rear direction and apart from the latched springs 522. Each of the latched protrusions 524 protrudes outward from the held part 520 in the radial direction of the held part 520. The cable attachment part 530 is positioned forward of the held part 520 in the front-rear direction. As shown in FIG. 27, the cable attachment part 530 is a part to be crimped to a core wire 810 of the cable 80. The pin contact 500 is formed by punching out a metal sheet and bending it.

Referring to FIGS. 21 to 24, the pin insulator 600 has an insertion part 610, a body part 620 and a base part 630. The insertion part 610 has a shape of two cylinders 612 which are arranged in parallel with each other in the lateral direction and coupled with each other. The insertion part 610 is formed to be insertable into the inserted part 328 (see FIG. 17) of the socket insulator 300. In the present embodiment, the insertion part 610 is formed to prevent the test finger prescribed in Electrical Appliances and Materials Safety Act from coming into contact with the pin contacts 500 even in a state that the insertion part 610 holds the pin contacts 500. That is, the mating connector 50 has an electric shock prevention structure. In detail, on an inner wall of each of the cylinders 612 is formed with a plurality of the internal protrusions 614 extending in the front-rear direction. In the present embodiment, each of the cylinders 612 is formed with a pair of the internal protrusions 614 protruding inward in the up-down direction and another pair of the internal protrusions 614 protruding inward in the lateral direction. The internal protrusions 614 reduce a substantial internal diameter of the cylinder 612 to make insertion of a finger difficult and to prevent an electric shock.

As shown in FIGS. 21 to 24, the body part 620 is positioned forward of the insertion part 610 in the front-rear direction. The body part 620 also has a shape of two cylinders 622 which are arranged in parallel with each other in the lateral direction and coupled with each other. As understood from FIG. 24, each of the cylinders 622 of the body part 620 is formed with a latching part 624. The latching part 624 is a protrusion part formed all around along an internal circumference of the cylinder 622. An external diameter of each of the cylinders 622 of the body part 620 is smaller than an external diameter of each of the cylinders 612 of the insertion part 610. As shown in FIGS. 21 to 24, the base part 630 is positioned forward of the body part 620 in the front-rear direction. The base part 630 has two cylinders 632 and a plurality of fins 634 formed around them. The pin insulator 600 is formed in a single body using insulating resin.

Figure 24:
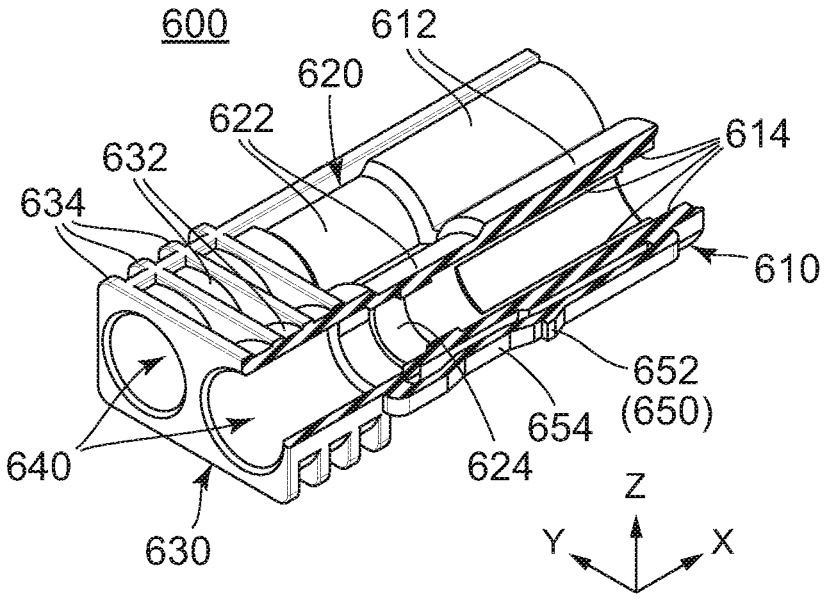
FIG. 24 is a perspective, sectional view showing the pin insulator of FIG. 21.

As understood from FIG. 24, the pin insulator 600 is provided with a plurality of pin accommodation parts 640 which pierce the insertion part 610, the body part 620 and the base part 630. In the present embodiment, the pin accommodation parts 640 are two in number. As shown in FIGS. 21 to 24, fitting locked parts 650 are formed at outsides of the pin insulator 600 in the lateral direction. Each of the fitting locked parts 650 has a fitting locked protrusion 652 and a fitting locked spring part 654 supporting the fitting locked protrusion 652. The fitting locked spring part 654 is a double-supported spring formed to extend from the insertion part 610 to the base part 630. The fitting locked spring part 654 is resiliently deformable and supports the fitting locked protrusion 652 so as to be movable in the lateral direction.

As understood from FIGS. 3 and 27, each of the pin contacts 500 is attached to an end part of the cable 80. As shown in FIG. 27, attaching the pin contact 500 to the cable 80 is carried out by crimping the cable attachment part 530 to the core wire 810 of the cable 80. Accordingly, as understood from FIGS. 28 and 29, when seen along the front-rear direction, a size of the cable attachment part 530 is smaller than a size of the cable 80.

Figure 31:
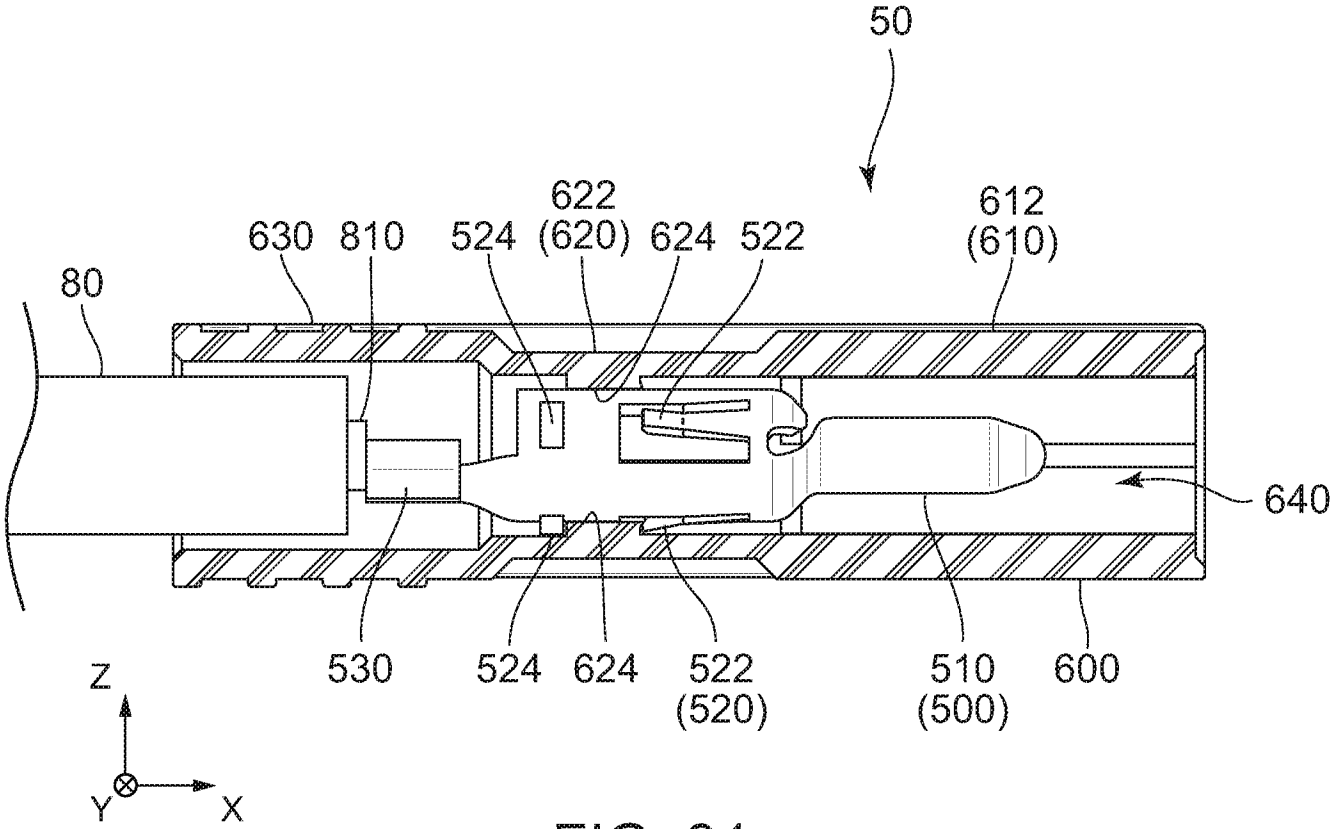
FIG. 31 is a vertical, partly sectional view showing the mating connector included in the connector assembly of FIG. 28. It includes a side view of the pin contact and a vertical, sectional view of the pin insulator.

As understood from FIGS. 3 and 31, attaching the pin contacts 500 to the pin insulator 600 are carried out by inserting the pin contacts 500 into the pin accommodation parts 640 from the front of the pin insulator 600. Here, each of the latching parts 624 formed on the body part 620 is formed to prevent the latched springs 522 and the latched protrusions 524 from passing therethrough. As understood from FIG. 31, the latched springs 522 are resiliently deformed upon coming into contact with the latching part 624 so that the latched springs 522 can be moved rearward of the latching part 624 in the front-rear direction. Then, the latched springs 522 return to their original state due to their reaction forces when they are once moved rearward of the latching part 624. On the other hand, the latched protrusions 524 are brought into abutment with the latching part 624 so that the latched protrusions 524 cannot be moved rearward of the latching part 624 in the front-rear direction. Thus, the latching part 624 is positioned between the latched springs 522 and the latched protrusions 524 in the front-rear direction. As a result, movements of the pin contacts 500 relative to the pin insulator 600 in the front-rear direction are regulated by the latching parts 624. As mentioned above, the held part 520 is held by the body part 620 of the pin insulator 600. The pin insulator 600 does not prevent rotation of the pin contact 500 around a rotation axis extending along the front-rear direction. In other words, the pin contacts 500 are held by the pin insulator 600 so as to be rotatable.

As understood from FIG. 28, when the connector 10 is mated with the mating connector 50, the insertion part 610 is inserted into the inserted part 328, and the fitting locked parts 650 are guided by the guide grooves 320. Moreover, the internal protrusions 614 of the insertion part 610 are received by the slits 314 of the inner cylindrical parts 312 at least in part. Furthermore, as understood from FIGS. 28 and 29, the fitting locked protrusions 652 are locked by the fitting lock parts 322. Then, the fitting lock parts 322 regulate forward movements of the fitting locked protrusions 652 in the front-rear direction. Thus, a mated state of the connector 10 and the mating connector 50 is locked. When parts of the fitting locked spring parts 654 are pushed inward in the lateral direction to move the fitting locked protrusions 652 inward, locks of the fitting locked protrusions 652 by the fitting lock parts 322 are released. In that state, the connector 10 and the mating connector 50 can be detached from each other.

Although the specific explanation about the present invention is made above referring to the embodiments, the present invention is not limited thereto but susceptible of various modifications and alternative forms without departing from the spirit of the invention. For example, although the description is made about the example that the stopper 200 is added to the combination of the socket contact 100 and the socket insulator 300 in the aforementioned embodiment, the stopper 200 may be added to the combination of the pin contact 500 and the pin insulator 600.

The present application is based on a Japanese patent application of JP2017-137900 filed before the Japan Patent Office on Jul. 14, 2017, the content of which is incorporated herein by reference.

While there has been described what is believed to be the preferred embodiment of the invention, those skilled in the art will recognize that other and further modifications may be made thereto without departing from the spirit of the invention, and it is intended to claim all such embodiments that fall within the true scope of the invention.

REFERENCE SIGNS LIST

10 connector
100 socket contact (terminal)
110 cylindrical part
112 contact-point-support part
114 contact point
116 tip
118 latching spring
120 latching protrusion
122 guide part
124 front end
126 rear end
130 cable attachment part
200 stopper
210 front part
212 latched part
214 front end
220 rear part
222 locked part
224 front surface
226 rear surface

228 lock spring part
230 rotation preventing protrusion
232 side part protrusion
240 receiving part
300 socket insulator
310 front part
312 inner cylindrical part
314 slit
316 contact stopper
318 outer cylindrical part
320 guide groove
322 fitting lock part
324 flange part
326 fixing hook
328 inserted part
340 rear part
342 cylindrical part
344 aperture
346 surrounding part
348 front edge part
350 rear edge part (locking part)
352 operation part
354 operation protrusion
356 operation spring part
358 recess
360 shallow channel part
370 socket accommodation part (housing part)
50 mating connector
500 pin contact
510 contact part
512 front part
514 rear part
520 held part
522 latched spring
524 latched protrusion
530 cable attachment part
600 pin insulator
610 insertion part
612 cylinder
614 internal protrusion
620 body part
622 cylinder
624 latching part
630 base part
632 cylinder
634 fin
640 pin accommodation part
650 fitting locked part
652 fitting locked protrusion
654 fitting locked spring part
70 panel
80 cable
810 core wire

The invention claimed is:

1. A connector attachable to a cable, wherein:
the connector comprises a plurality of terminals, a plurality of stoppers and a socket insulator;
each of the terminals has a cylindrical part and a cable attachment part;
the cable attachment part is a portion to be attached to the cable and positioned rearward of the cylindrical part in a front-rear direction;
the stoppers are made of insulating resin and attached to the terminals, respectively;
each of the stoppers is provided with a locked part and a lock spring part;
the locked part is supported by the lock spring part;
the lock spring part is resiliently deformable;
the socket insulator is formed with a plurality of housing parts, a plurality of locking parts and a plurality of operation parts;
the housing parts extend in the front-rear direction;
the stoppers are housed in the housing parts together with terminals, respectively;
each of the housing parts has a front end portion which opens and is positioned forward of the cylindrical part in the front-rear direction;
the locking parts are positioned rearward of the locked parts and regulate rearward movements of the stoppers, respectively, in a state that the stoppers are housed in the housing parts;
the operation parts are operable and movable in a predetermined direction intersecting the front-rear direction; and
when operated, the operation parts move the locked parts along the predetermined direction to respectively release regulation of the locked parts caused by the operation parts.

2. The connector as recited in claim 1, wherein:
each of the terminals is provided with a latching spring and a latching protrusion;
the latching spring protrudes outward from the cylindrical part in a radial direction of the cylindrical part;
the latching protrusion is positioned rearward of and apart from the latching spring in the front-rear direction;
the latching protrusion protrudes outward from the cylindrical part in the radial direction;
the cable attachment part is positioned rearward of the latching protrusion in the front-rear direction;
each of the stoppers is formed with a latched part; and
in a state that the stoppers are attached to the terminals, respectively, the latched part is positioned between the latching spring and the latching protrusion in the front-rear direction.

3. The connector as recited in claim 2, wherein:
the latching spring is positioned forward of the stopper in the front-rear direction; and
the latched part is positioned at a front end of the stopper.

4. The connector as recited in claim 2, wherein:
each of the stoppers has a cylindrical shape;
the latched part is formed all around along an inner periphery of the stopper;
the terminals are respectively held by the stoppers to be rotatable; and
the stoppers are held by the socket insulator not to be rotatable.

5. The connector as recited in claim 1, wherein the lock spring part is a double supported spring.

6. The connector as recited in claim 1, wherein the front end part of the housing part has an internal diameter smaller than an external diameter of the cylindrical part.

7. The connector as recited in claim 1, wherein:
the operation part has an operation protrusion and an operation spring part which supports the operation protrusion;
the socket insulator is formed with a surrounding part;
the operation part is surrounded by the surrounding part; and
the operation protrusion protrudes outward through the surrounding part in the predetermined direction.

8. The connector as recited in claim 1, wherein:
the socket insulator is provided with a fixed part to be fixed to a panel of a device; and in a state that the socket insulator is fixed to the panel, the operation part is positioned inside the device.

* * * * *